US011095020B2

(12) United States Patent
Lindenmeier et al.

(10) Patent No.: US 11,095,020 B2
(45) Date of Patent: Aug. 17, 2021

(54) COMBINATION ANTENNA FOR MOBILE SERVICES FOR VEHICLES

(71) Applicant: FUBA Automotive Electronics GmbH, Bad Salzdetfurth (DE)

(72) Inventors: Stefan Lindenmeier, Gauting (DE); Heinz Lindenmeier, Planegg (DE)

(73) Assignee: FUBA Automotive Electronics GmbH

( * ) Notice: Subject to any disclaimer, the term of this patent is extended or adjusted under 35 U.S.C. 154(b) by 0 days.

(21) Appl. No.: 16/861,298

(22) Filed: Apr. 29, 2020

(65) Prior Publication Data

US 2021/0135341 A1 May 6, 2021

(30) Foreign Application Priority Data

Apr. 29, 2019 (DE) ..... 102019003079.6

(51) Int. Cl.

| | |
|---|---|
| ***H01Q 1/32*** | (2006.01) |
| ***H01Q 1/24*** | (2006.01) |
| ***H01Q 1/40*** | (2006.01) |
| ***H01Q 1/38*** | (2006.01) |
| ***H01Q 11/14*** | (2006.01) |

(52) U.S. Cl.

CPC ..... *H01Q 1/246* (2013.01); *H01Q 1/32* (2013.01); *H01Q 1/3275* (2013.01); *H01Q 1/38* (2013.01); *H01Q 1/405* (2013.01); *H01Q 11/14* (2013.01)

(58) Field of Classification Search

CPC ..... H01Q 1/32; H01Q 1/3275; H01Q 1/246; H01Q 1/38; H01Q 1/405; H01Q 11/14

See application file for complete search history.

(56) References Cited

U.S. PATENT DOCUMENTS

| | | | | |
|---|---|---|---|---|
| 7,057,563 | B2 * | 6/2006 | Cox | H01Q 1/085 343/700 MS |
| 7,265,719 | B1 * | 9/2007 | Moosbrugger | H01Q 21/0025 343/700 MS |
| 2009/0009421 | A1 * | 1/2009 | Suprunov | H01Q 1/38 343/881 |
| 2016/0104932 | A1 | 4/2016 | Aminzadeh et al. | |

FOREIGN PATENT DOCUMENTS

| | | | |
|---|---|---|---|
| DE | 102005054286 | A1 | 5/2007 |
| DE | 102014013926 | A1 | 3/2016 |
| DE | 102016123369 | A1 | 6/2017 |

OTHER PUBLICATIONS

European Search Report for related European Application No. 20171891.3; dated: Sep. 22, 2020; 4 pages.

* cited by examiner

*Primary Examiner* — Hoang V Nguyen
(74) *Attorney, Agent, or Firm* — Dickinson Wright PLLC

(57) ABSTRACT

A combination antenna for mobile radio or for mobile radio and broadcasting services comprises at least one plastic film arranged above a base plate and coated with conductive antenna structures; and at least one antenna connection point coupled to antenna structures on the electrically conductive base plate as an electrical counterweight of the combination antenna.

15 Claims, 17 Drawing Sheets

COMBINATION ANTENNA FOR MOBILE SERVICES FOR VEHICLES

The invention relates to a combination antenna for mobile radio services or for mobile radio and broadcasting services. Antennas for mobile radio services from the prior art are designed as contiguous electrically conductive structures, for example, from sheet metal. Such antennas can be manufactured economically and even have the advantageous property of a three-dimensionally configurability. However, the mechanical combination of a plurality of such antennas which can be manufactured at a favorable cost in this technology to form a combined antenna system, comprising a series of individual antennas, nevertheless remains economically expensive.

Antennas are likewise known that are manufactured from planar plastic plates coated with electrical conductors, with the electrically conductive antenna elements being printed on. The advantage of this antenna technology comprises the accuracy and the variety with which the structures sensitive to natural frequency can be reproduced. Under the condition of reasonable manufacturing costs, these antennas are restricted to two-dimensional structures. A further disadvantage—as with antennas comprising contiguous electrically conductive structures—is the high manufacturing costs that are associated with the space-saving spatial and mechanical combination of a plurality of such antennas on the vehicle in mass production.

In particular for the use of antennas on vehicles, the space requirement on the vehicle surface, the installation height, their aerodynamic shape, and their wind resistance value are of importance. However, the economy of the manufacture of such an antenna has special significance due to the large volumes customary in automotive construction.

Figure 1A:
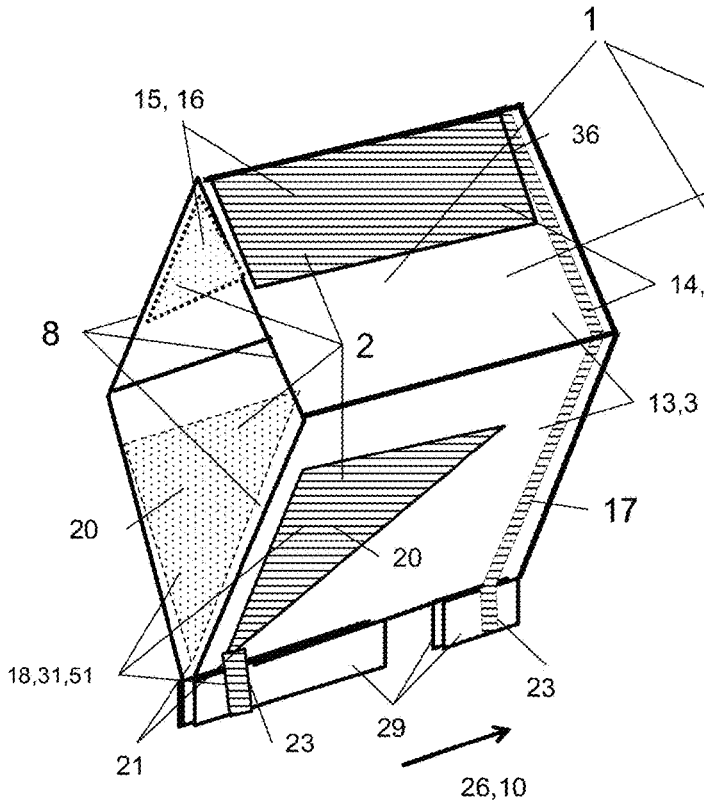

The large number of modern mobile radio networks such as are designed in accordance with the mobile radio standard LTE (long term evolution) or are still in development requires antennas having extreme bandwidths. For example, as is shown in FIG. 1C, a frequency range between 698 and 960 MHz—called the lower band in the following—and the frequency range between 1460 MHz and 2700 MHz above a frequency gap, called the lower band in the following here, are provided for the LTE mobile radio standard. A middle band in the frequency range between 1460 MHz and 1700 MHz is frequently additionally provided and is to be assigned to the upper band. With respect to the antenna function, the frequency gap between the lower band and the upper band is desired for protection against the radio services located there. There is frequently a demand to provide a plurality of such mobile radio antennas for a plurality of users on one vehicle. In addition, a respective antenna is frequently required for AM radio and FM radio.

Naturally, the use of the antennas and antenna arrangements presented in this document is in no way restricted to the LTE system mentioned as an example here. Furthermore, these antennas and antenna arrangements can be particularly advantageously used in all communication systems in which multi-antenna systems are used in the frequency ranges described, for example in communication systems such as 5G, WLAN and vehicle-to-vehicle communication (Car2Car), e.g. in accordance with the IEEE802.11p standard, etc. For these applications, antennas are required that, in addition to the electrical function, are suitable for vehicles due to their compactness and their stylistic characteristics, wherein the economy of the manufacture is of particular importance.

It is therefore the object of the invention to provide an antenna in which a combination antenna comprising a plurality of mechanically and electrically integrated individual antennas for mobile radio services is designed in a compact manner of construction in a simple and economically less expensive manufacturing process.

This object is satisfied by the features of claim 1.

Advantageous embodiments of the invention are described in the dependent claims and in the description.

A combination antenna 1 for mobile radio services is disclosed, comprising at least one plastic film 3 arranged above a base plate 5 and coated with conductive antenna structures 2; and at least one antenna connection point 4 coupled to antenna structures 2 on the electrically conductive base plate 5 as an electrical counterweight of the combination antenna 1 comprising the following features:

Starting from an in particular stiff, but bendable plastic film 3 coated with conductive antenna structures 2, in particular having the approximate shape of a rectangle or trapezoid, having two mutually parallel broad side margins 6*a*, 6*b* and having first and second longitudinal side margins 7*a*, 7*b*, the plastic film 3 is folded or shaped into a folding body 8 or film tube 8 that in particular extends cylindrically or slightly conically at a longitudinal side.

The shaping of the film tube 8 is designed by a multiple bending along straight bending lines 9 in a longitudinal direction 10.

In an embodiment variant, the two longitudinal side margins 7*a*, 7*b* of the plastic film 3 are combined on the base plate 5 and are mechanically connected thereto along a fastening line 44 in parallel with the center line 12 of the base plate 5 extending at the longitudinal side, whereby the jacket 13 of the folding body 8, i.e. the tube jacket 13 in the embodiment shown, is segmented by the bending lines 9 and the longitudinal side margins 7*a*, 7*b*.

Due to the distribution of the bending lines 9, the cross-section of the tube jacket 13 can be formed as a polygon standing on its apex and having surfaces 19 oriented in a V shape in the lower third of the total extent h of up to 12 cm above the base plate 5. In the embodiment shown, the cross-section of the folding body is diamond-shaped or has the shape of a kite.

At least one vertical monopole antenna 14 for radio services with frequencies below 1 GHz and at least one broadband monopole antenna 18 for radio services with frequencies above 1 Ghz are present that are each formed from conductive antenna structures 2 and that are each provided with an antenna connection point 4.

To design at least one vertical monopole antenna 14 for radio services below 1 GHz, a longitudinally extended areal conductor structure 16 designed as a roof capacity 15 can be present in an upper region of the tube jacket 13 located above the conductive base plate 5, said conductor structure 16 being connected at at least one point via a conductor track 17 printed on the tube jacket 13 to an antenna connection point 4 formed on the fastening line 44.

To design at least one broadband monopole antenna 18 for frequencies above 1 Ghz, the tube jacket 13 is designed from surfaces or segments 19 in the lower region which are oriented in a V shape with respect to one another and on each of which an areal and conductive triangular structure 20 standing on a triangle apex 21 and having the triangle height 54 can be present, with both triangle apexes 21 that converge at the bottom comprising an antenna connection point 4.

The design of the folding body or of the plastic film 3 can (before the folding) start from a generally stiff, but bendable or foldable plastic film 3 coated with conductive antenna structures 2. The initial shape or the blank of the planar plastic film 3 can approximately correspond to the shape of a rectangle or trapezoid having two mutually parallel broad side margins 6*a*, 6*b* and having first and second longitudinal side margins 7*a*, 7*b*. The plastic film 3 can accordingly be formed into a cylindrically or slightly conically designed film tube 8 extending in a longitudinal direction 10. In the embodiment shown in FIGS. 1 to 3, 11 and 15, the folding body is folded into a parallelepiped.

The shape of the film tube 8 can be produced by bending or kinking the plastic film 3 along straight bending lines 9 in the longitudinal direction 10. The bending lines can also be imparted into the plastic.

To shape the film tube 8, the two longitudinal side margins 7*a*, 7*b* of the plastic film 3 can be combined on the base plate 5. They can be mechanically connected to the base plate 5 along a fastening line 44 in parallel with a center line 12 of the base plate 5 extending at a longitudinal side. Thus, the tube jacket 13 of the film tube 8 can be regularly or irregularly segmented by the bending lines 9 and the longitudinal side margins 7*a*, 7*b*.

Due to the distribution of the bending lines 9, the cross-section of the tube jacket 13 can be formed as a polygon standing on its apex and having a V shape in the lower region of the total extent h of a maximum of 12 cm above the base plate 5.

To design at least one vertical monopole antenna 14 for radio services below 1 Ghz, a longitudinally extended areal conductor structure 16 designed as a roof capacity 15 can be formed on the plastic film 3 in the upper region of the tube jacket 13 located above the conductive base plate 5. Said conductor structure 16 can be connected at at least one point via a printed conductor track 17 on the tube jacket 13 to an antenna connection point 4 formed on the fastening line 44.

To design at least one broadband monopole antenna 18 having the character of a conical broadband monopole antenna 31 for frequencies above 1 Ghz, the respective conductive structure of a triangular structure 20 standing on the triangle apex 21 can be present in the lower region of the tube jacket 13 located above the conductive base plate 5 on both sides of the surfaces 19 oriented in a V shape with respect to one another at the lower end of the tube jacket 13. The lower triangle apexes 21 are electrically connected to one another. They can form the connection point for an antenna connection point 4 formed on the fastening line 44.

The electrically conductive base plate 5 can be designed as a coated circuit board 22 having a respective cutout of the conductive layer for designing an antenna connection point 4 that can comprise a connection pad 23 on the plastic film 3 and a ground connection 24 on the circuit board 22.

The electrically conductive base plate 5 can be disposed on the outer skin of a vehicle and the coated film tube 8 can be inserted into the inner hollow space 25 of a shell-like dielectric antenna protective cover 11 and surrounded by the latter in such a manner that the longitudinal side of the base plate 5 is oriented in parallel with the direction of travel 26 and the antenna protective cover 11 can be mechanically connected to the conductive base plate 5 at its opening margin.

To mechanically stabilize and fix the film tube 8, the inner surface 28 of the shell-like antenna protective cover 11 can be designed with an exact shape in such a manner that contact points 27 between the bending lines 9 of the plastic film 3 and the inner surface 28 of the shell-like antenna protective cover are provided. To mechanically stabilize and fix the folding body 8, the wall of the inner hollow space 25 can also have at least one molded-on contact edge, in particular a straight-line contact edge, that enables a line contact along a contact line 27 between the bending line 9 of the plastic film 3 and the inner surface 28 of the antenna protective cover 11. The folding body can hereby also be clamped in the antenna protective cover.

Edge tabs 29 can be formed at the longitudinal side margins 7*a*, 7*b* of the coated plastic film 3 and the electrically conductive base plate 5 can be designed as a circuit board 22 along whose longitudinal-side fastening line 44 a slit-shaped collection apparatus 30 is guided into which the edge tabs 29 of the plastic film 3 can be inserted in a correspondingly angled manner and can thereby be mechanically held.

To electrically couple at least one of the antenna elements to the at least one antenna connection point 4 located on the circuit board 22, a connection pad 23 can be designed on at least one of the edge tabs 29 and a contact element 45 for contacting the connection pad can be present on the circuit board 22, in each case at the slit-shaped collection apparatus 30 of the circuit board 22.

At least one combined LTE antenna 42 can be formed from the broadband monopole antenna 18 for the LTE upper band having the character of a conical monopole antenna 31 and from an antenna for the LTE lower band that can comprise the vertical monopole antenna 14 having a longitudinally extended conductor structure 16 which is designed as a roof capacity 15 and which can be designed in the upper region of the tube jacket 13, located above the conductive base plate 5, having a printed conductor track 17 to an LTE antenna connection pad 32 common to both frequency bands.

A plurality of combined LTE antennas 42 can be present of which at least two comprise the same roof capacity 15 that can be connected via a respective printed conductor track 17 to a separate connection pad 23.

Antenna structures 2 can be present on the plastic film 3 for at least one combined LTE antenna 42 having a longitudinally extended conductor structure 16 designed as a roof capacity 15 and for an AM/FM monopole antenna 33 for AM/FM radio reception, wherein the AM/FM monopole antenna 33 can comprise the same longitudinally extended areal conductor structure 16 as a roof capacity 15, but having a separate conductor track connection 41 to a separate AM/FM antenna connection pad 47, wherein a respective separate antenna connection point 4 can be formed on the fastening line 44 for each combined LTE antenna 42.

A respective combined LTE antenna 42 having a printed conductor track 17 between the end of the conductor structure 16, longitudinally extended over the film tube 8, of the roof capacity 15 and the combined LTE antenna connection pad 32 can be formed at both ends of the folding body or of the film tube 8 and the top load connection point 36 of the separate conductor track 41 to the conductor structure 16 of the roof capacity 15 toward the AM/FM antenna connection pad 47 can be provided approximately at the longitudinal-side center of the film tube 8.

The inner cross-section of the dielectric antenna protective cover 11 can be substantially similar to the cross-section of a bell that tapers toward the tip and the cross-sectional shape of the folding body or of the film tube 8 can be inscribed in the inner cross-section of the antenna protective cover 11 in such a manner that, at the height h1 with a suitable selection of the opening angle 53 of the tube jacket surfaces 19 impacting one another in a V shape at the fastening line 44, bending lines 9 and suitable bending angles 35 are designed on both cross-section sides at contact points 27 with the inner antenna protective cover 11 and a further bending line with a bending angle 35 is present at the inner tip at the height h of the antenna protective cover 11 in such a manner that both a sufficient width and the full utilization of the available height h below the antenna protective cover 11 are provided in a gable roof-shaped design of the cross-section of the tubular structure for the areal roof capacity 15.

To further increase the effect of the roof capacity 15, a respective further bending line with contact at the inner antenna protective cover 11 and a corresponding bending angle 35 can be selected at a height h2 disposed above the height h1 above the base plate 5 on the cross-section sides, disposed opposite one another with respect to the cross-section center line 48, in such a manner that a mansard roof-shaped design of the structure for the areal roof capacity 15 is achieved.

The inner cross-section of the dielectric antenna protective cover 11 can be substantially similar to that of a semicircle in sections and a respective further bending line with contact at the inner antenna protective cover 11 can be selected at a large number of heights h2, h3, h4, . . . disposed above the height h1 above the base plate 5 in such a manner that the tube jacket 13 above the height h1 is sequentially adapted to the cross-sectional semicircle and the cross-sectional width 46 of the areal structure of the roof capacity 15 is designed to optimize the effect.

With a sufficient inherent rigidity and shape accuracy of the film tube 8, the contact with the antenna protective cover at the bending lines 9 for mechanically fixing the film tube 8 do not necessarily have to be strictly provided, wherein, however, the utilization of the available hollow space 25 of the antenna protective cover 11 can nevertheless be effectively provided.

It is possible that an LTE combination antenna 42 having a triangular structure 20 and having the conductor track 17 to a conductive structure of the roof capacity 15 disposed thereabove is printed at at least one of the longitudinal-side ends of the folding body or of the film tube 8 and an AM/USW monopole antenna 33 can be present that is connected to the same structure for the roof capacity 15 via a separate conductor track connection 41, with mutually spaced apart top load connection points 36 being able to be selected for the decoupling of the two antennas.

Instead of the closed areal structure of the roof capacity 15, the electromagnetic decoupling of the two mutually spaced apart top load connection points 36 can be increased by the inductive effect of a meandering conductor structure 37, wherein the oscillation amplitude 38 can be selected over the cross-sectional width 46 of the areal structure of the roof capacity 15.

To improve the electromagnetic decoupling between the broadband monopole antenna 18 for the LTE upper band and the monopole antenna 14 for the LTE lower band, the areal conductive triangular structure 20 can be designed by strip-shaped conductive fins 39 arranged in a fan-like manner in the triangle plane and converging at the lower triangle apex 21.

To approximate the conical character of an LTE upper band antenna 31 having an LTE antenna connection pad 32 at one of the longitudinal ends of the folding body or of the film tube 8, the planar plastic film 3 serving as a starting point can be extended by a further conductive triangular structure 40, whose lower triangle apex 21 is connected to the LTE antenna connection pad 32 and which is provided with a suitable opening angle, in such a manner that after the design of the film tube 8 by a bending of the extended triangular structure 40 along the broad side margin 6*a*, the two mutually oppositely disposed triangular structures 20 are supplemented by the further triangular structure 40 in the sense of a cone reproduction.

Figure 9:
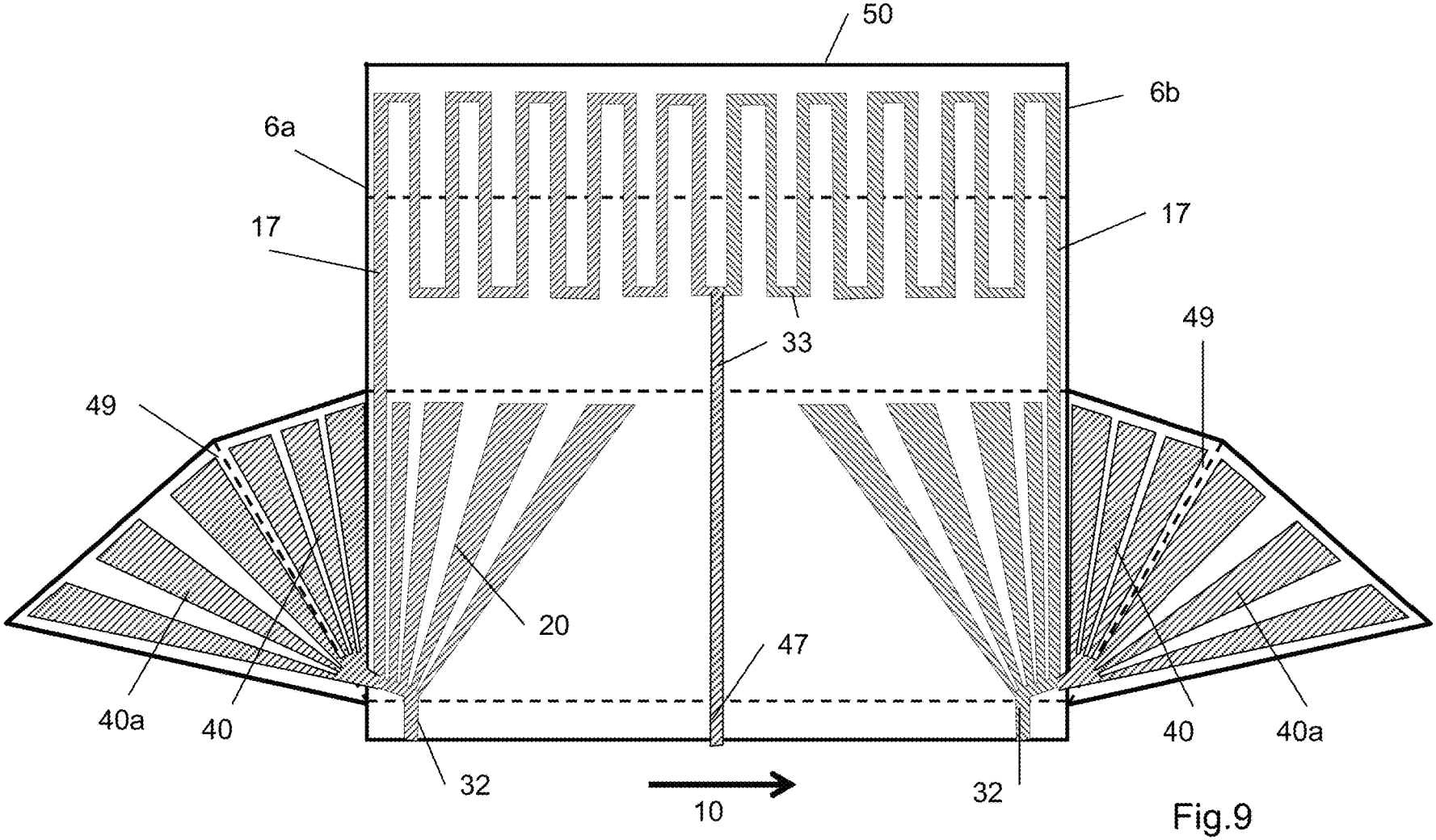
Figure 10:
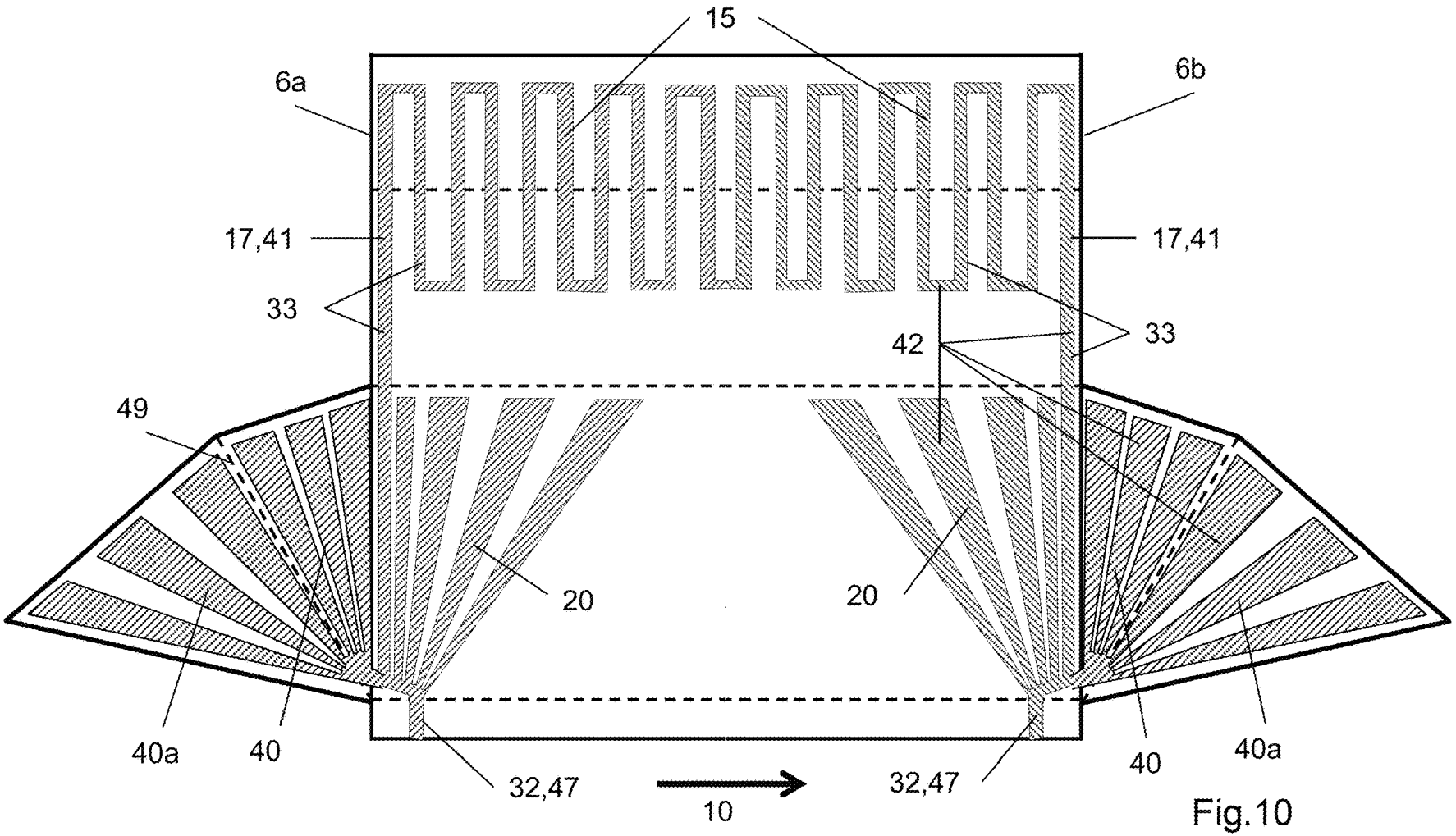

In accordance with a further embodiment, a folding body or a film tube 8 can also be provided whose jacket is not completely closed. In the embodiment of FIGS. 8 to 10, a folding body having a tube jacket 13 open in cross-section is inscribed in the inner cross-section of the antenna protective cover 11 in such a manner that, when only one of the two longitudinal side margins 7*a* is fastened to the fastening line 44, a bending line 9 and there a suitable bending angle 35 are designed at the height h1 on only one of the cross-section sides at contact points 27 with the inner antenna protective cover 11, wherein a further bending line 9 with a bending angle 35 can be present at the inner tip at the height h of the antenna protective cover 11 in such a manner that, starting from there, the end 50 of the plastic film is reached after a gable roof-shaped design of the cross-section of the open tubular structure for the areal roof capacity 15.

It can be possible that, as compensation for the omission of one of the two triangular structures 20 oriented in a V shape with respect to one another for approximating the conical character of an LTE upper band antenna 31 at at least one of the longitudinal ends of the film tube 8, the planar plastic film 3 serving as the starting point is extended along the broad side margin 6*a* by a first further conductive triangular structure 40 and it can furthermore be possible that a second further triangular structure 40*a* is attached to said first further conductive triangular structure 40 via a common connection side 49 in such a manner that, after the design of the open film tube 8 by an approximately right-angled bending of the first further conductive triangular structure 40 along the broad side margin 6*a* and by an approximately right-angled bending of the second further triangular structure 40*a* along the common connection side 49 of the two mutually attached further triangular structures 40, 40*a*, the remaining triangular structure 20 and the second further triangular structure 40*a* are oriented in a V shape with respect to one another and the lower triangle apexes 21 of all the triangular structures 20, 40,40*a* are connected to the LTE antenna connection pad 32.

It is possible that a large number of combined LTE antennas 42 for frequencies below and above 1 GHz, each having a separate roof capacity 15 and a separate LTE antenna connection pad 32, are arranged in series along the longitudinal side of the film tube 8.

However, it is possible that the structures for designing the LTE antenna 42 are applied to one of the two sides of the tube jacket 13 and a substantially rectangular further structure 69, guided in parallel with the roof capacity 15 at a minimum spacing 68 substantially at a longitudinal side with respect to the roof capacity 15 and capacitively coupled thereto, is present at the side of the tube jacket 13 opposite thereto in order to support the frequency range below 1 GHz and is connected to a further conductor strip 67 for designing a ground connection 24, said further conductor strip 67 being of high impedance for frequencies above 1 GHz and being provided with a connection pad 23 at its lower end.

The invention will be explained in more detail in the following with reference to embodiments.

The associated Figures show in detail:

FIG. 1A:

A perspective representation of the basic shape of a three-dimensional combination antenna 1 comprising a plastic film 3 with printed-on antenna structures 2 as a film tube 8 (parallelepiped) in accordance with the invention combined from a monopole broadband antenna 18 for frequencies above 1 GHz and a monopole antenna 14 for frequencies below 1 GHz. The broadband monopole antenna 18 is formed from electrically conductive triangular structures 20 on surfaces 19 oriented in a V shape with respect to one another. Their triangle apexes are electrically connected to one another and together with a connection pad 23 at the lower end. A broadband monopole antenna 31 having an almost conical shape is thus formed, whereby its behavior is substantiated over a large frequency bandwidth. The monopole antenna 14 designed for lower frequencies below 1 GHz is formed from a roof capacity 15 and from a printed conductor track 17 toward a connection pad 23. The roof capacity 15 is designed as a longitudinally extended conductor structure 16 that extends in the shape of a gable roof over the total length of the film tube 8. To design antenna connection points 4, the electrically conductive connection pads 23 for both the broadband monopole antenna 18 and the monopole antenna 14 are printed on the edge tabs 29. For the configuration of the antenna on a vehicle, the longitudinal direction of the films 8 can be oriented along the direction of travel 26.

FIG. 1B:

A cross-sectional representation of the combination antenna 1 in accordance with the invention at a) above an electrically conductive base plate 5 as a counterweight to the antennas on the plastic film 3 below an antenna protective cover 11. The cross-section of the film tube 8 is shaped by way of example as an irregular square with the surfaces 19 oriented in a V shape with respect to one another at the lower end. The rows of the edge tabs 29 formed at both margins of the plastic film 3 are joined at the lower end of the film tube 8. To form antenna connection points 4, contact elements 45 for contacting the connection pads 23 printed on the edge tabs 29 are designed on the base plate 5. In the example, the film tube 8 of the antenna protective cover 11 is inscribed in such a manner that it is mechanically supported via contact points 27 with the inner surface 28 of the antenna protective cover 11.

FIG. 1C:

Frequency ranges in accordance with the LTE mobile radio standard as an example of two frequency bands in the decimeter wave spectrum separated by a frequency gap with a frequency range between 698 and 960 MHz as the LTE lower band and a frequency range between 1460 MHz and 2700 MHz as the LTE upper band above a frequency gap. In a design of a combination antenna 1 in accordance with the invention for the two frequency ranges in accordance with the LTE mobile radio standard, the broadband monopole antenna 18 is thus associated with the LTE upper band and the monopole antenna 14 is associated with the LTE lower band.

FIG. 2:

For a further explanation of the design of the combination antenna 1 in FIGS. 1A-1C, the Figure shows in a perspective part view the folding body or the film tube 8 in accordance with the invention, characterized by broken lines below the antenna protective skin 11, designed in a bell shape in cross-section, in a perspective representation. The film tube 8 is formed by a kinking or bending of the otherwise planar plastic film 3 along the bending lines 9 in the longitudinal direction 10 in such a manner that contact points or contact lines 27 for the mechanical stabilization of the film tube 8 are provided on the inner surface 28 of the antenna protective cover 11. The film tube 8 is formed at its lower end by joining the edge tabs 29 at both margins of the plastic film 3, said edge tabs 29, for example, being inserted into a slit-shaped collection apparatus 30 (slits) that is formed approximately centrally in the longitudinal direction 10 on the base plate 5. Antenna connection points 4 are indicated by broken circular lines as cutouts of the electrically conductive layer on the base plate 5. The base plate 5 is preferably designed as a coated circuit board 22. The contact elements 45 fastened thereto are each in a contact closure with a connection pad 23 on the edge tabs 29 and form the antenna connection point for a furthergoing antenna feed line (not shown) together with the ground point 24 in each case. Due to a suitable selection of the height h1 of the bending line 9 above the base plate 5, a suitable opening angle of the surfaces 19 oriented in a V shape in the lower region of the tube jacket 13 is made possible for the design of the broadband monopole antenna 18 for the upper band. The height h1 for the first bending line 9 above the base plate 5 can thus at least be selected as high as the triangle height 54 of the triangular structure 20 standing on the triangle apex 21. Said triangle height 54 is, in turn, calculated by the frequency range with which the broadband monopole antenna 18 is associated, thus the frequency range between 1460 MHz and 2700 MHz in the case of the LTE upper band. To access this frequency range, a triangular structure 20 having a triangle height 54 in the order of magnitude of approximately 3-5 cm can therefore be advantageous.

Equally, the roof capacity 15 can hereby be dimensioned by utilizing the total available height h in the upper region of the film tube 8 for the design of the monopole antenna 14 for the lower band. In particular for reasons of vehicle aesthetics, a construction height h that is as small as possible is aimed for. Realistic values therefore lie between 5 cm and 12 cm for the total height h.

Figure 3A:
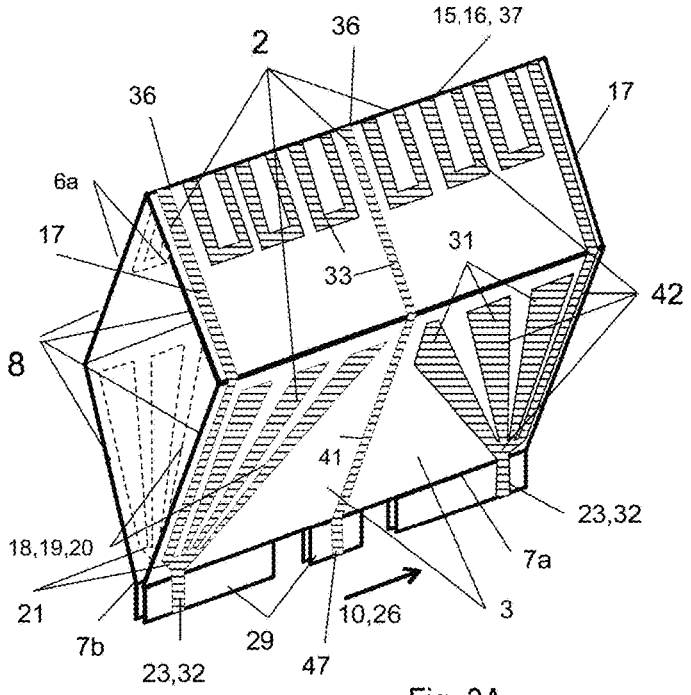
Figure 3B:
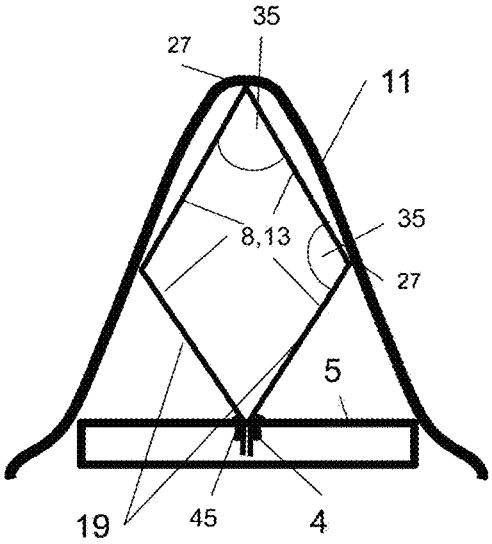
Figure 3C:
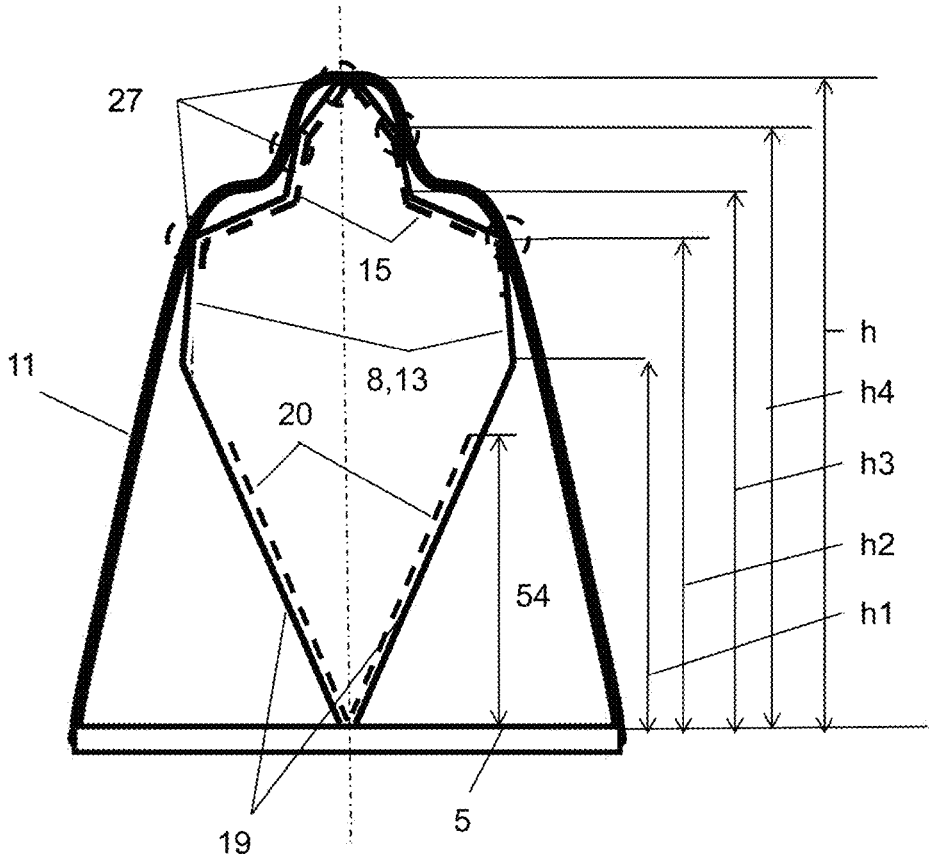

FIGS. 3A-3C shows by way of example the advantageous way in which a large number of antennas can be designed on a folding body or on a film tube 8. A respective combined LTE antenna 42 is applied at both ends of the film tube 8 and the antenna structures 2 of an AM/FM monopole antenna 33 are applied in the central region.

FIG. 3A:

The perspective representation shows a broadband monopole antenna 18 for frequencies above 1 GHz at the left end of the film tube 8—i.e., for example, an LTE upper band antenna 51—comprising the two triangular structures 20 on the mutually oppositely disposed surfaces 19 oriented in a V shape. The triangle apexes 21 at the lower end terminate on both sides at a respective connection pad 23 on the edge tabs 29, whereby a conically designed broadband monopole antenna 31 is approximately achieved. At these connection pads 23, the broadband monopole antenna 18 is in each case combined with a monopole antenna 14 below 1 GHz for the LTE lower band. This LTE lower band antenna 52 is formed from the roof capacity 15 and its connection line as a printed conductor track 17 to one of the connection pads 23 so that the connection pad 23 likewise forms the LTE connection pad 32 for the combined LTE antenna 42. After the insertion of the film tube 8 into the slit-shaped collection apparatus 30, the connection pads 23 on both sides are electrically connected to one another via the contact element 45 attached in a fitting manner there and form the antenna connection point 44 for the combined LTE antenna 42 together with the ground point 24 there.

To improve the electromagnetic decoupling between the LTE upper band antenna 51 and the LTE lower band antenna 52, the triangular structure 20 is designed by conductive strip-shaped fins 39 arranged in a fan-like manner in the triangle plane and converging at the lower triangle apex 21. Equally, it is advantageous for the electromagnetic decoupling of the antenna structures 2 for the LTE upper band antenna 51 and the LTE lower band antenna 52 to provide an inductive effect in the form of a meandering conductor structure 37 for the frequencies in the LTE upper band instead of the closed areal structure of the roof capacity 15. To maintain the capacitive effect of the conductor structure 16 longitudinally extended over the total length of the film tube 8, the oscillation amplitude 38 is suitably selected over the cross-sectional width 46 of the areal structure of the roof capacity 15 (cf. FIG. 4).

In a complete reflection of this, a further combined LTE antenna 42 is designed at the other end of the film tube 8 in this example. The common use of the same roof capacity 15 designed as a meandering conductor structure 37 is particularly advantageous in this respect, with a sufficient decoupling of the two LTE lower band antennas 51 being provided at both ends of the film tube 8.

In addition, a further monopole antenna 14 below 1 GHz is designed as an AM/FM monopole antenna 33 for AM/FM radio, comprising the roof capacity 15 and the separate conductor track connection 41 toward the AM/FM antenna connection pad 47. By selecting the top load connection point 36 for the separate conductor track connection 41 to the meandering conductor structure 37 approximately at the longitudinal-side center of the film tube 8, a sufficient electromagnetic decoupling of the antennas from one another is provided. This decoupling can additionally be further increased by a high-impedance design of the furthergoing circuit to be connected to the AM/FM antenna connection pad 47—such as of an amplifier with a high input impedance both in the AM frequency range and in the USW frequency range.

FIG. 3B

Figure 1B:
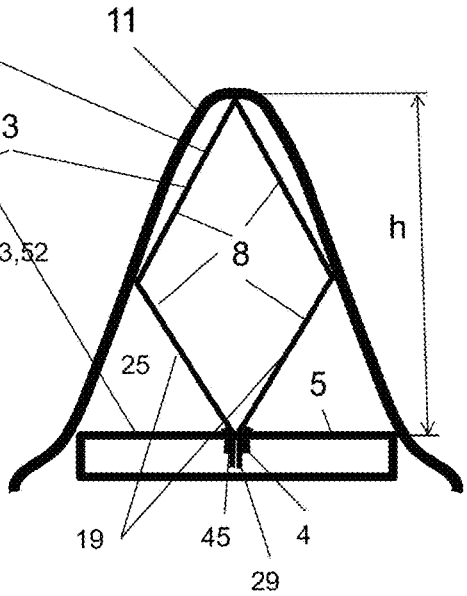
Figure 1C:
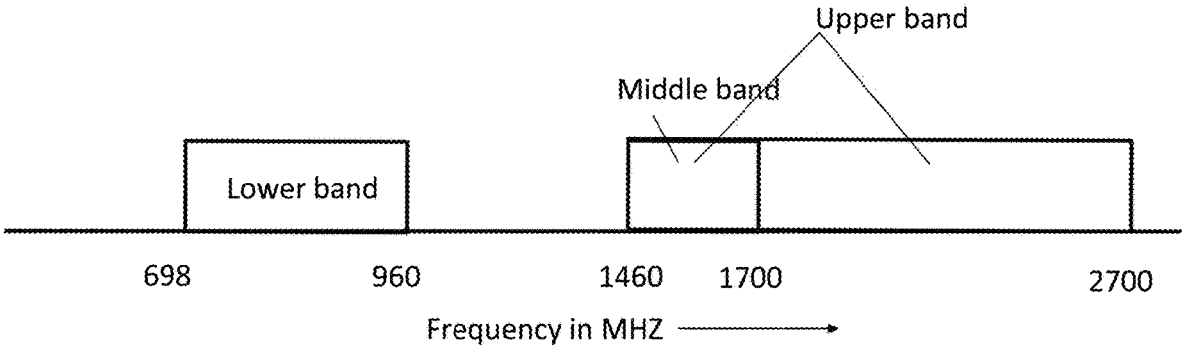

A cross-sectional view of the film tube 8 in FIG. 3A similar to in FIG. 1B. The film tube 8 is inscribed in the cross-sectional shape of the antenna protective cover 11 on the basis of the dimensions of the planar basic shape of the plastic film 3 and of the suitable bending angles 35. In an advantageous way, both the available height h and the available transverse dimension for the film tube 8 are hereby utilized with only a few folds or bending operations to design the tube jacket 13.

FIG. 3C:

A cross-sectional view of the film tube 8 below an antenna protective cover 11 with a pronounced comb-like shape at the upper end. To utilize the total available height h, the film tube 8 is adapted to the inner contour of the antenna protective cover 11 in its upper region. A roof capacity 15 with the largest possible conductor surface proportions can hereby be designed at a large spacing from the base plate 5 for the optimization of the antenna—in particular at the lower end of the frequency band—as indicated by broken lines in FIG. 3C. In the lower part of the film tube 8, the surfaces 19 oriented in a V shape are designed up to the height h1. The triangular structures 20 applied at both sides to these surfaces are likewise indicated by broken lines. In the case shown by way of example, in addition to the bends of the two edge tabs 29, nine bending lines 9 are present at the heights h1, h2, h3, h4 and h to adapt the contour of the cross-section to the inner shape of the antenna protective cover 11.

Figure 2:
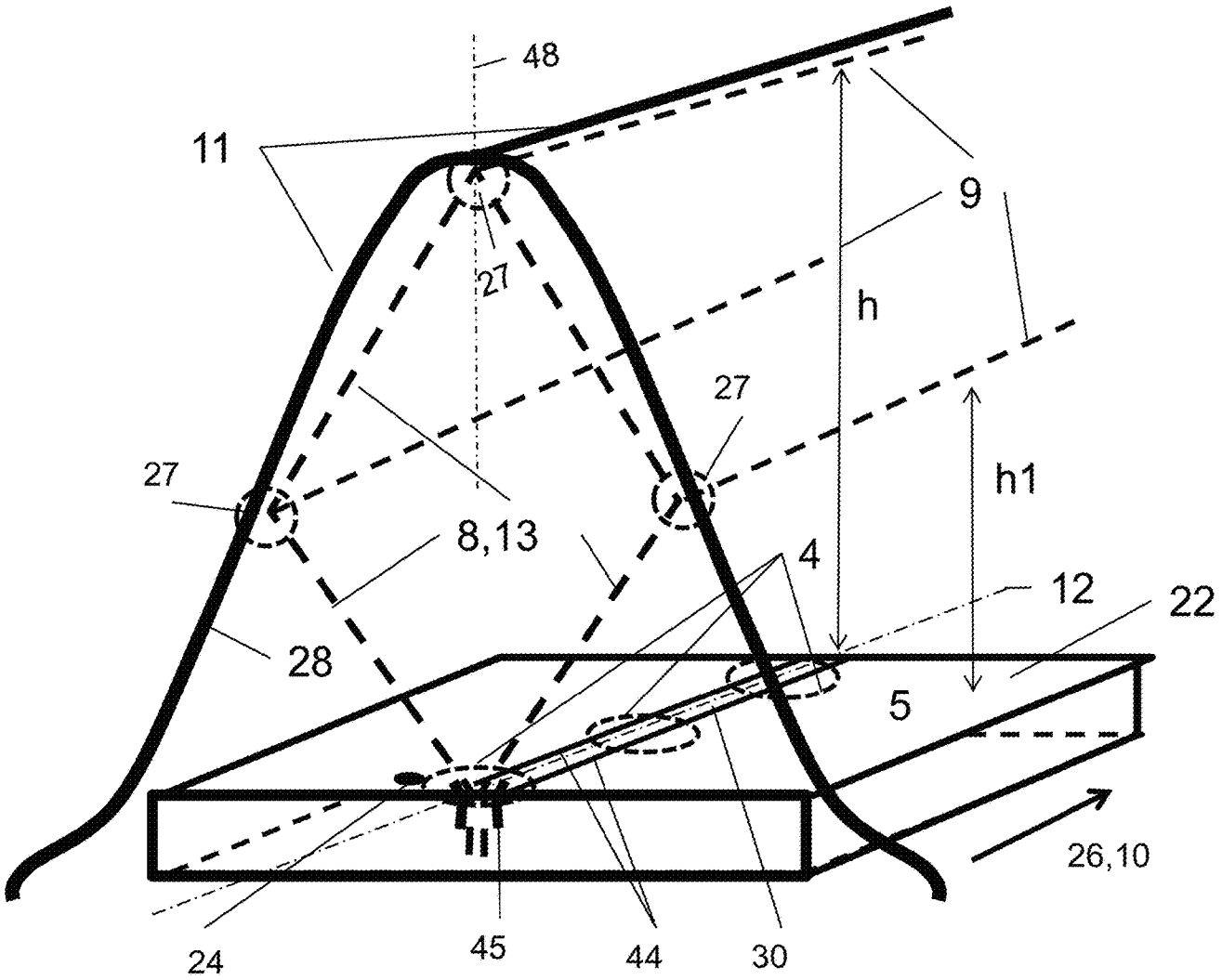

FIG. 4:

A cutaway view or cut for a symmetrical film tube 8 in accordance with the invention with two LTE antennas and a central decoupling for implementing the AM/FM monopole antenna 33. The design of the film tube 8 in accordance with the invention starts from a regular, stiff but bendable rectangular plastic film 3 shown by way of example here that is coated with conductive antenna structures 2. The printing of the antenna structures 2 on the plastic film 3 can generally take place at the upper and/or lower side. In the example, the antenna structures 2 are applied to the visible side so that, after a bending along the bending lines 9 about the corresponding bending angles 35 shown in FIG. 3B, they come to lie on the outer side of the tube jacket 13, as shown in FIG. 3A. Further bends along the left-side and right-side longitudinal side margins 7*a*, 7*b* of the plastic film enable the design of the edge tabs 29 for the mechanical fastening along the slit-shaped collection apparatus 30. In FIG. 2, the longitudinal direction 10 and the direction of travel 26 are defined as shown. Thus, the broad side margin 6*a* forms the end of the film tube 8 shown at the left in FIG. 3A and the broad side margin 6*b* forms the end of the film tube 8 shown at the right in FIG. 3A. The top load connection points 36 for the printed conductor tracks 17 of the two LTE lower band antennas 52 are located in the vicinity of the broad side margins 6*a*, 6*b*, in each case at an end of the film tube 8. The top load connection point 36 for the separate conductor track connection 41 for the AM/FM monopole antenna 33 is attached at the center of the meandering conductor structure 37 of the top load 15. The oscillation amplitude 38 and the conductor width of the meandering conductor structure 37 are selected in a predefined cross-sectional shape of the antenna protective cover 11 for the monopoles 14 below 1 GHz in accordance with a favorable weighting from the designable effective height, from the magnitude of the capacitance value of the roof capacity 15 and from the electromagnetic decoupling.

Figure 4:
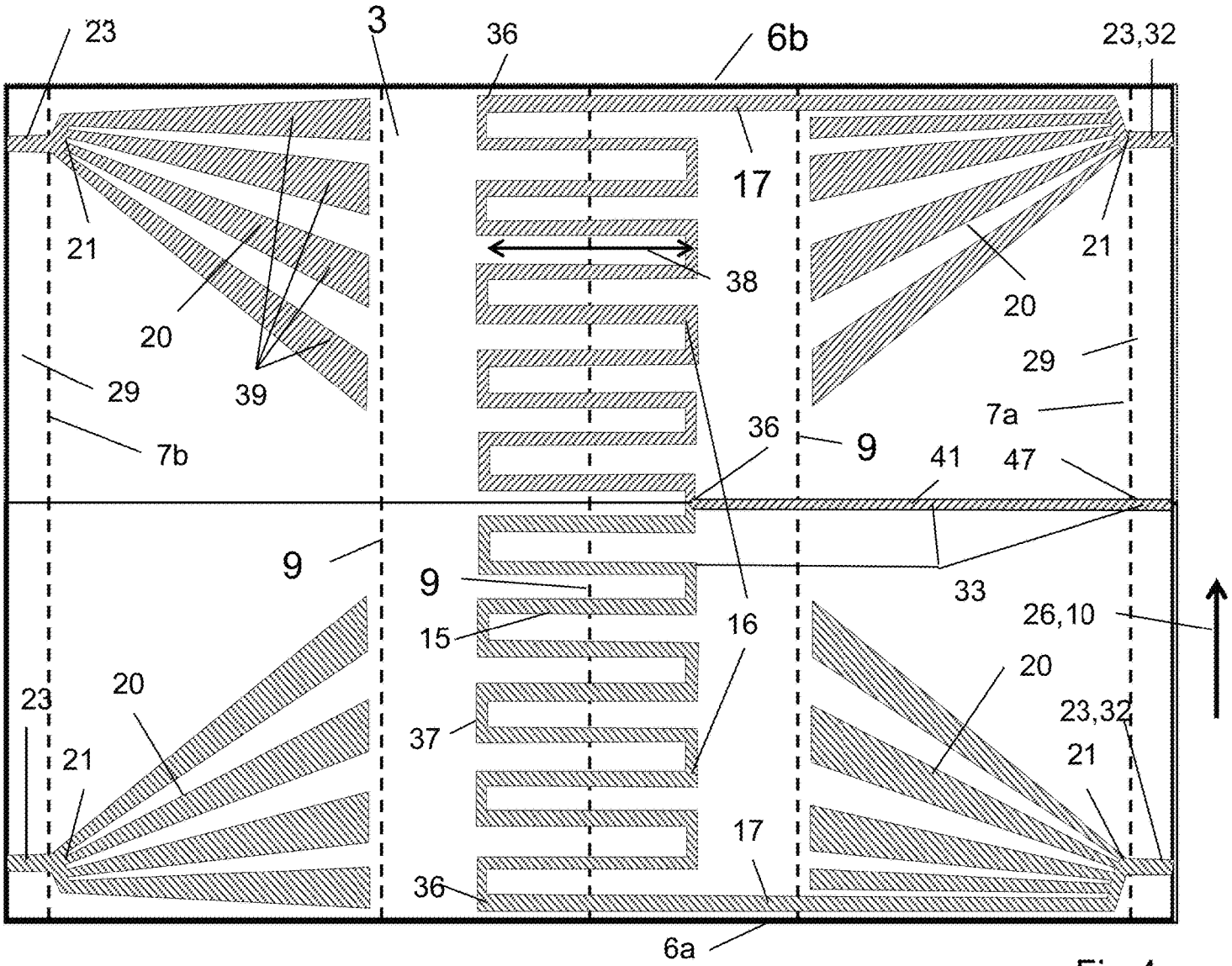

FIG. 5:

A cutaway view of the plastic film 3 of a film tube 8 symmetrical in the longitudinal direction 10 as in FIG. 4 with two LTE antennas with a central decoupling for AM/FM, but with meanders offset with respect to one another, that is centrally irregular meanders.

Figure 5:
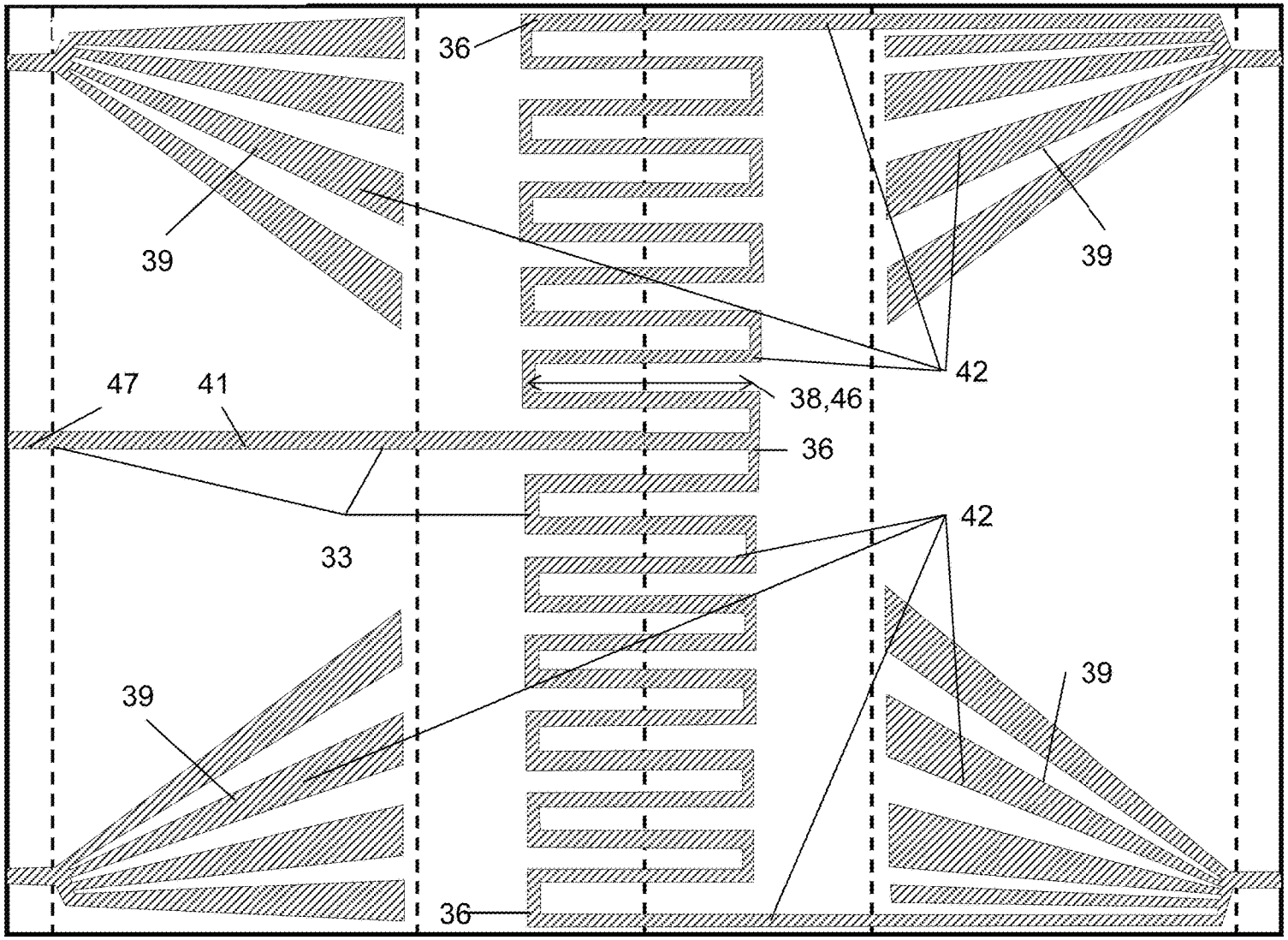

FIG. 6:

A cutaway view of the plastic film 3 of a symmetrical film tube 8 as in FIGS. 4 and 5 with two LTE antennas, but with double almost central top load connection points 36 and with AM/FM antenna connection pads 47 joined at both sides.

FIG. 7:

A cutaway view of the plastic film 3 of a symmetrical film tube 8 as in FIGS. 4 and 5 with two LTE antennas, but without a top load connection point 36 for a separate conductor track connection 41 to an antenna connection pad 47, but with a respective common conductor track connection 41, 17 to a common LTE AM/FM antenna connection pad 32, 47.

FIG. 8: A combination antenna 1 with a folding body or film tube 43 open over the periphery with two combined LTE antennas 42 and an AM/FM monopole antenna 33 having a central top load connection point 36.

Figure 8A:
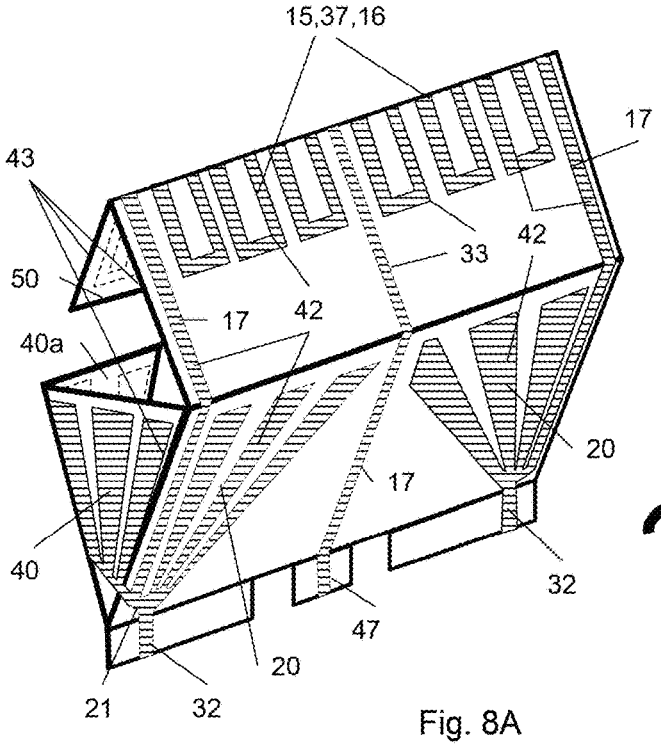

FIG. 8A: As compensation for the omission of one of the two triangular structures 20 oriented in a V shape with respect to one another, the plastic film 3 is extended at the longitudinal end of the folding body 43 along the broad side margin 6*a* by a first further conductive triangular structure 40 and a second further triangular structure 40*a* is attached to the latter via a common connection side 49. Due to an approximately right-angled bending of the first further conductive triangular structure 40 along the broad side margin 6*a* and to an approximately right-angled bending of the second further triangular structure 40*a* along the common connection side 49 of the two mutually attached further triangular structures 40, 40*a*, the remaining triangular structure 20 and the second further triangular structure 40*a* are oriented disposed opposite one another in a V shape and the lower triangle apexes 21 of all the triangular structures 20, 40, 40*a* are connected to the LTE antenna connection pad 32.

FIG. 8B:

A cross-sectional representation of the open folding body 43 with the open end 50 of the shortened plastic film 3.

Figure 8B:
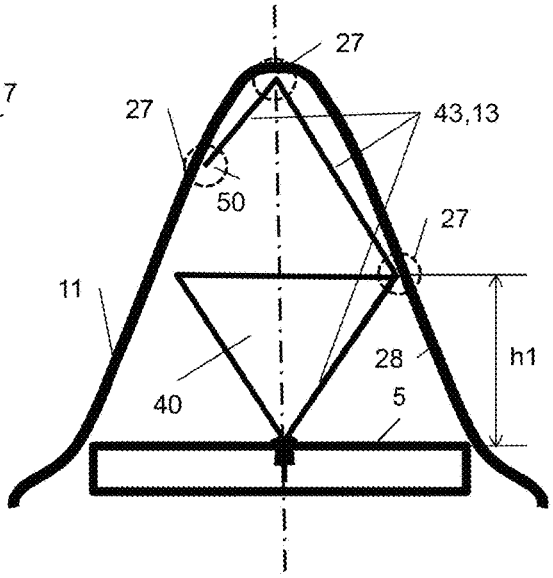

FIG. 9:

A cutaway view of the plastic film 3 of the open film tube 43 in FIG. 8B with a representation of the first further conductive triangular structure 40 and of the second further conductive triangular structure 40*a* attached via the common connection side 49. The shortening of the plastic film 3 results from the shortening of the broad side margins 6*a* and 6*b*.

FIG. 10:

A cutaway view of the plastic film 3 of the open film tube 43 as in FIG. 9, but without a central top load connection point for the AM/FM monopole antenna 33, but with a common connection pad 32, 47 for the combined LTE antenna 42 combined with the AM/FM monopole antenna 33.

FIG. 11A:

A film tube 8 as in FIGS. 3A-3C in a perspective representation, but with a large number of combined antennas 42 for frequencies below and above 1 GHz, each having a separate roof capacity 15 and a separate LTE antenna connection pad 32 of the individual antennas. The antennas 42 are arranged in series along the longitudinal side of the film tube 8. In addition, more or less conical broadband monopole antennas 55 for frequencies—designed above 6 GHz—are arranged on the film tube 8 in the free spaces beside the combined antennas 42. These broadband antennas are also each equipped with an antenna connection pad for contacting a connector on the base plate 5 designed as a coated circuit board 22.

FIG. 11B:

A side view of a film tube 8 with antenna structures in connection with a coated circuit board 22 on which further circuit components are attached. For this purpose, the example shows a satellite ring antenna 56*a* and a satellite ring antenna 56*b* formed from two concentric rings, with both satellite ring antennas being attached to the coated circuit board 22. Cutouts 57 in the folding body or in the film tube 8 enable the spatial combination of the film tube with the coated circuit board 22 equipped with one or more satellite antennas. Such cutouts can naturally be provided in all the embodiments shown.

To design LTE group antennas, the base points of the individual antennas 42 can be connected to one another via electrical lines or inductive and capacitive circuit elements (not shown) in all the embodiments. These line and circuit elements can advantageously be printed onto the film tube 8. In case of strict demands on the accuracy of the directional pattern of the group antenna aimed for in this respect, the connection between the antennas can advantageously take place as a print onto the folding body or onto the film tube 8 and thus without an electrical transition contact onto the circuit board 22. The print can be implemented with very small tolerances with a high long-term stability of the electrical properties. This technology is also particularly advantageous for the implementation of decoupling circuits between the individual antennas on which particularly high demands are made with respect to the accuracy and long-term stability.

FIG. 12:

A side view of a cutout of the film tube 8 with the structure of a combined LTE antenna 42 having an LTE connection pad 32 at the base point to form the antenna connection point 4 on the electrically conductive base surface 5, implemented as a coated circuit board 22. The antenna 42 comprises the areal triangular structure 20 standing on its apex as a monopole above 1 GHz and the roof capacity 15 that are connected via two conductor strips 17, each having a meandering shape 62, to the triangular structure 20 to form the monopole for frequencies below 1 GHz.

Figure 12:
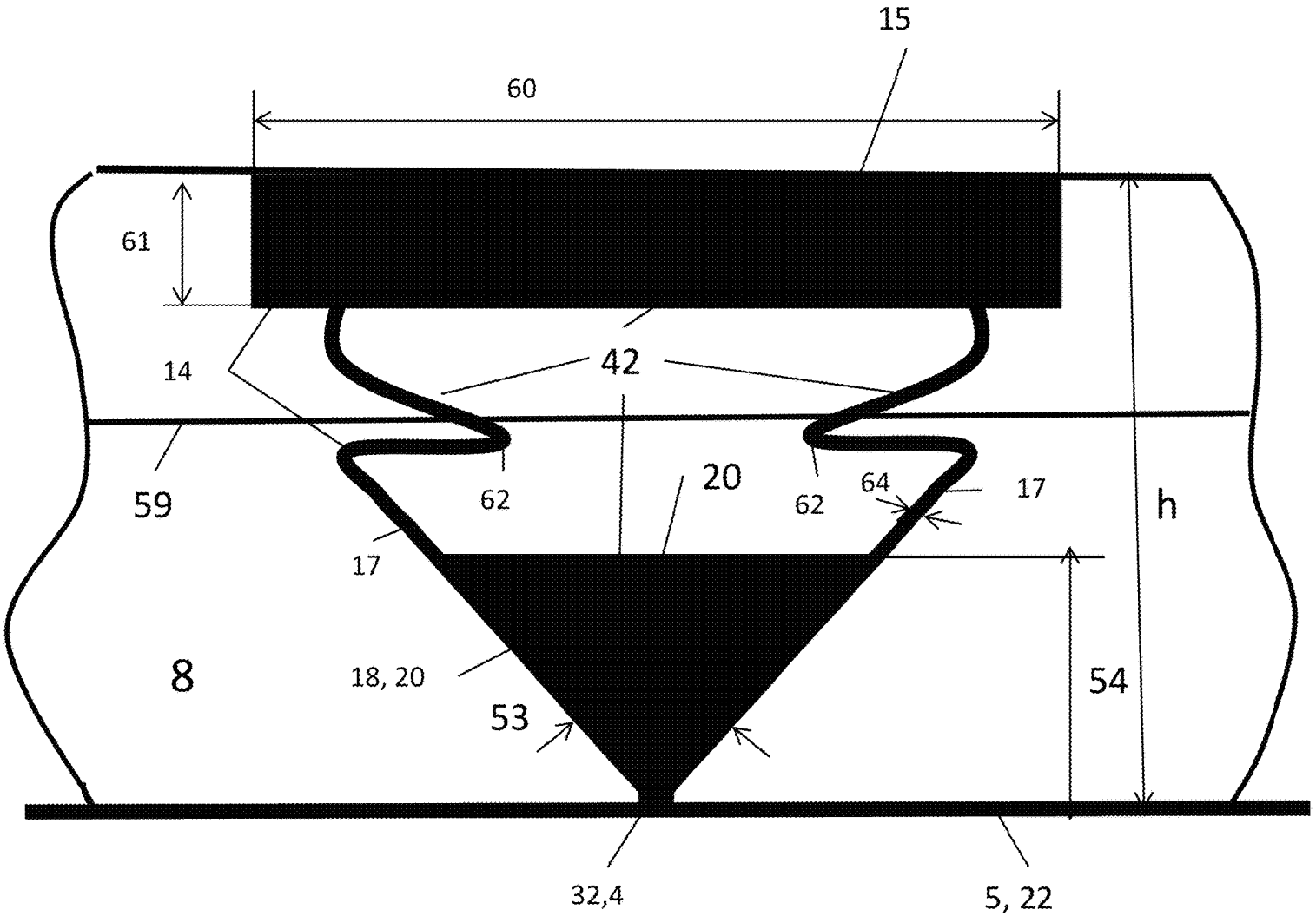

FIG. 13:

A side view of a cutout of the film tube 8 with the antenna 42 as in FIG. 12, however, with the areal triangular structure 20 of the monopole for frequencies above 1 GHz being designed by strip-shaped fins 39 arranged in a fan-like manner in the triangle plane and converging at the lower triangle apex.

Figure 13:
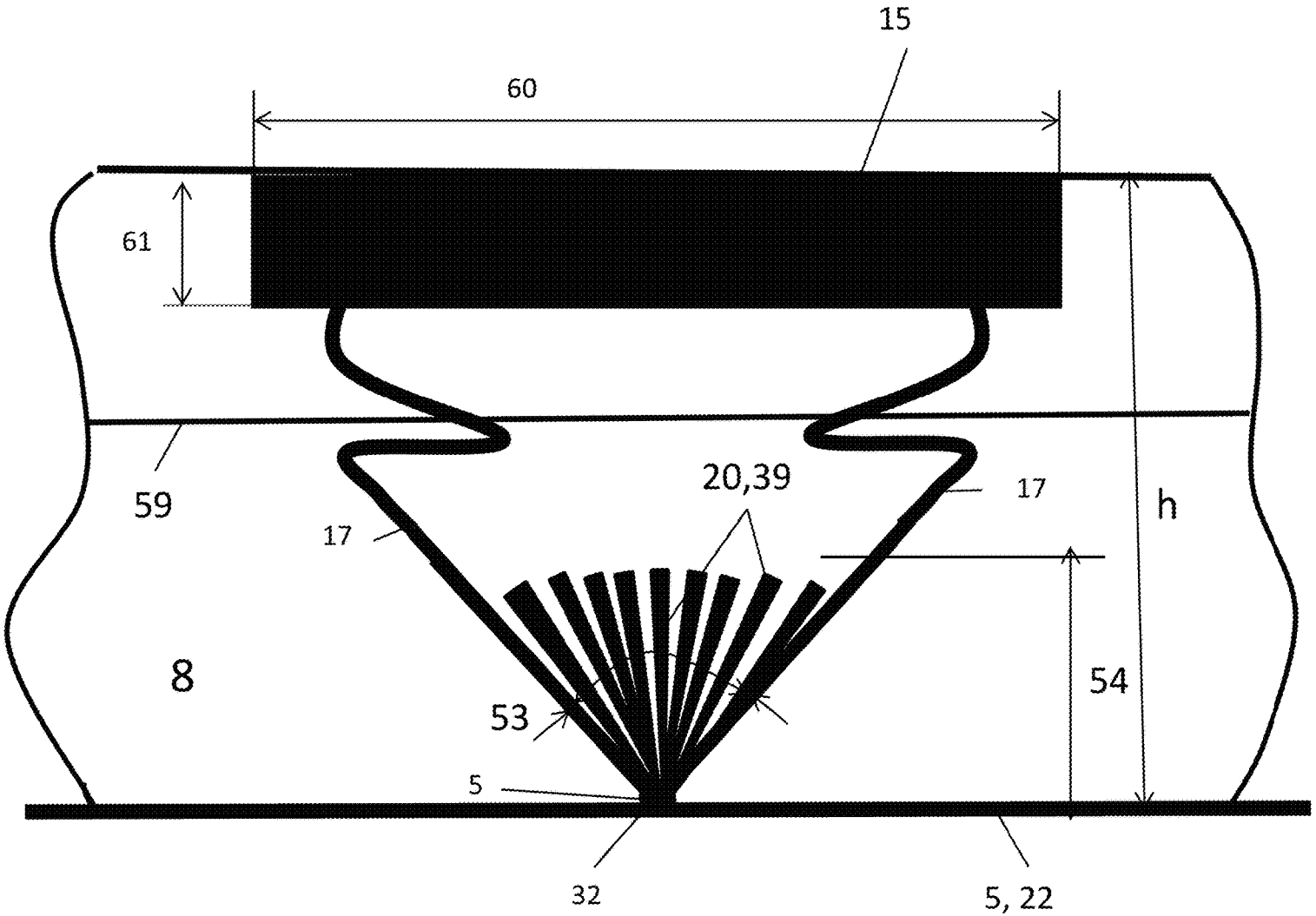

FIG. 14:

A side view of the film tube 8 with an antenna 42 as in FIG. 13, but with only one conductor strip 17 for coupling the roof capacity 15 to a plurality of meandering shapes 62 to achieve the necessary inherent inductivity of the conductor strip 17. To improve the electromagnetic decoupling between spatially adjacent satellite antennas and the areal rectangular structure 16 of the roof capacity 15 having a longitudinal extent 60, said rectangular structure 16 is formed by strip-shaped end fins 63 that extend vertically separate from one another, but are contiguous at their upper end via a remaining strip 70.

Figure 14:
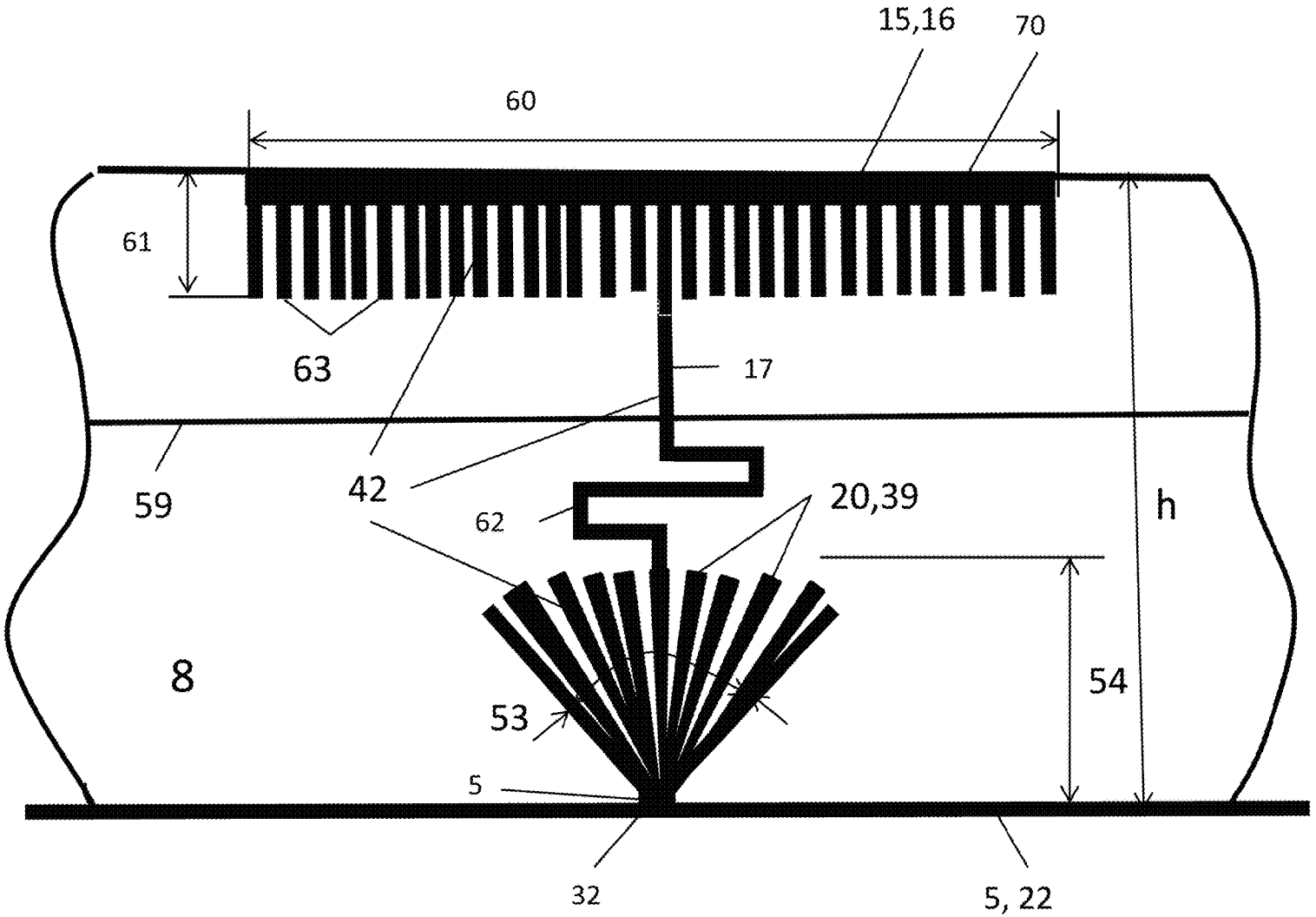

FIG. 15:

A semi-perspective side view of a cutout of a film tube 8 (chain-dotted) with an LTE antenna 42 as in FIG. 14, but whose structures are applied to one of the two sides of the tube jacket 13—the front tube jacket 65. A further substantially rectangular structure 69, guided in parallel with the roof capacity 15 at a minimum spacing 68 substantially at a longitudinal side with respect to the roof capacity 15 and capacitively coupled thereto, is designed at the side of the tube jacket 13 opposite thereto—the rear tube jacket 66—in order to support the frequency range below 1 GHz. The rectangular structure 69 is connected via a further conductor strip 67 (broken line) that is provided with a connection pad 32 at its lower end to design a ground connection 24. To electromagnetically decouple the broadband monopole antenna above 1 Ghz 18, the further conductor strip 67 is designed with high impedance for frequencies above 1 GHz and is provided with meandering shapes 62 for this purpose.

Further advantages of the invention will be described in detail in the following:

A special advantage of a combination antenna 1 in accordance with the invention is the possibility to place a plurality of antennas for different frequency ranges and/or different radio services in a particularly compact manner on a common mechanical carrier. Special space savings results from the possibility of partly using antenna structures 2 a multiple of times for the design of the different antennas. The combination of all the antennas into a combination antenna 1 on a plastic film 3 printed at one or both sides with a good conductive material structure and having a thickness of between e.g. 0.1 mm and 0.5 mm enables a particularly low-effort manufacture in a single printing process. The subsequent bending along less straight folds or bending lines 9 about previously known bending angles 35 is likewise extremely low-effort by means of very simple automatic production machines for mass production. Equally, the mechanical fixing and contacting with a base plate 5, designed as a conductively coated circuit board 22, by the slit-shaped collection apparatus 30 having contact elements 45 at the antenna connection points 4 can be carried out in a particularly simple manner without complex soldering. Thus, the total manufacturing process for the combination antenna 1 in accordance with the invention is particularly suitable for mass production for vehicles. For the installation on vehicles, the longitudinal direction 10 of the film tube 8 with the antenna protective cover 11 is advantageously oriented in the direction of travel 26.

Particularly large frequency bandwidths can be achieved with conical monopole antennas. Such antennas are particularly suitable for frequencies above 1 GHz, that is for the LTE upper band. The three-dimensional design of the film tube 8 in accordance with the invention in FIG. 1A advantageously enables the implementation of an antenna by approximating the antenna shape of a cone. Based on the cross-section of the tube jacket 13 as a polygon standing on its apex and having surfaces 19 oriented in a V shape in the lower region up to one half of the total height h, a monopole is formed with the shape of an inverse pyramid that also approximates the sought conical shape with respect to the electrical behavior. The two triangular structures 20, which are disposed opposite one another on the surfaces 19 oriented in a V shape with respect to one another and which are conductively connected to one another at their lower apexes toward the antenna connection point 11, are very similar to the shape of a cone so that an LTE upper band antenna 51 with a very broadband frequency behavior is formed. On the same film tube 8, a monopole antenna 14 is additionally designed as an LTE lower band antenna 52 for frequencies below 1 GHz comprising the roof capacity 15 and the printed conductor track toward the connection pad 23. The arrangement of this antenna is arranged in such a space-saving manner that the roof capacity 15 designed as a longitudinally extended conductor structure 16 covers the LTE upper band antenna 51 at a sufficient spacing. It can be seen from the cross-sectional drawing in FIG. 1B in what way the available hollow space 25 in the interior of the antenna protective cover 11 is used in order, on the one hand, to enable a sufficiently large opening angle of the surfaces 19 oriented in a V shape with respect to one another in the lower part of the film tube 8 and in order, on the other hand, to implement the largest possible roof capacity 15 in the upper part of the film tube 8.

In an advantageous embodiment of the invention, the cross-section of the film tube 8 is designed adapted to the shape of the inner surface 28 in FIG. 2 in such a manner that contact points 27 of the film tube 8 with the inner surface 28 of the antenna protective cover 11 are produced, and thus a mechanical fixing against vibrations is provided, by a bending of the plastic film 3 along the bending lines 9. This fixing is also effective when the contact with the inner surface 28 is not strictly provided, but, due to an existing residual spacing, the respective oscillation amplitude of the film tube 8 is low enough in the case of vibrations not to impair the electrical properties of the combination antenna 1. Generally, the film tube 8 can be mechanically fixed via connection pads 24 with the aid of soldering support points—formed on the electrically conductive base plate 5. However, in an embodiment of the invention that is substantially lower in effort and therefore more advantageous, a slit-shaped collection apparatus 30 into which the edge tabs 29 formed at the film tube 8 are inserted in a form-fitted manner is designed—as in FIG. 2—in the longitudinal direction 10 on the base plate 5. Contact elements 45 insulated from the conductive base plate 5 are present at the antenna connection points 4 and establish the contact with the connection pads 23 on the edge tabs 29. Furthergoing circuits such as antenna amplifiers, cable connections, etc. can be designed as low-effort in an advantageous embodiment of the electrically conductive base plate 5 as a coated circuit board 22.

In a particularly advantageous further development of the invention, the film tube 8 in FIG. 3A is a carrier of two symmetrical versions of a combined LTE antenna 42 and of an AM/FM monopole antenna 33 with a top load connection point 36 approximately at the center of the longitudinally extended conductor structure 16 as a top load.

The combined LTE antenna 42 is in each case—as in FIG. 1—applied as conical broadband monopole antennas 18 for the LTE upper band on the surfaces 19 oriented in a V shape as triangular structures 20 so that they span an inverse pyramid that is similar to the shape of a cone. The printed conductor track 17, located at the end of the film tube 8, for forming an LTE lower band antenna 52 equally leads to the connection pad 23 of said combined LTE antenna 42 as a connection to the longitudinally extended conductor structure 16 designed in the upper region of the film tube 8. The connection pad 23 is thus likewise the LTE antenna connection pad 32 for the combined LTE antenna 42.

Two LTE lower band antennas 52, two LTE upper band antennas 51 and one AM/FM monopole antenna 33, i.e. a total of five antennas, are thus implemented on the film tube 8 in an extremely space-saving manner. Their antenna structures 2 are electromagnetically coupled to one another due to the partial dual use and to the small spatial spacings from one another. In an advantageous further development of the invention, the areal triangular structures 20 are—for a better decoupling—designed by strip-shaped fins 39 arranged in a fan-like manner in the triangle plane and converging at the lower triangle apex. Equally, instead of the closed areal structure of the roof capacity 15, the electromagnetic decoupling of the mutually spaced apart top load connection points 36 is increased by the inductive effect of a meandering conductor structure 37. The inductive and capacitive effects of the meandering conductor structure 37 can be matched with the oscillation amplitude 38 and with the conductor width of the meandering over the cross-sectional width 46 of the areal structure of the roof capacity 15. This matching can advantageously take place in such a manner that, with a suitable impedance termination of each of the two combined LTE antennas 42, located at the ends of the film tube 8, at the associated LTE antenna connection pad 32 for the FM antenna, the advantageous function of a laterally symmetrical inverted-F antenna is achieved at the AM/FM antenna connection pad 47.

It can be seen from FIG. 4 that the flat plastic film 3 can be printed in a simple manner in order, starting therefrom, to reach the film tube 8 described. The Figure shows as an example the cutaway view of the symmetrical version 1 with two combined LTE antennas and the central decoupling for the AM/FM monopole antenna 33. In a design of the plastic film 3 as a rectangle with equally long broad side margins 6*a*, 6*b*, the bend at the bending lines 9 results, as described, in a film tube 8 that does not taper in the longitudinal direction 10. If one assumes a plastic film 3 in the form of a trapezoid with a shorter front broad side margin 6*a* than the rear broad side margin 6*b* so that all the longitudinally directed lines in the image meet at a distant point, a conical film tube 8 tapering toward the front of the vehicle results. Due to the special design of the flat plastic film 3, the shape of the film tube 8 can advantageously be adapted to an antenna protective cover 11 predefined by the design. In a design of the film tube 8 by a kinking at the bending lines 9, the two LTE connection pads 32 come together locally and are jointly contacted via the contact element 45 at the associated antenna connection point 4 on an insertion into the slit-shaped collection apparatus 30.

FIG. 5 shows a cutaway view variant in accordance with the invention as in FIG. 4 with two combined LTE antennas 42 and a central decoupling at the top load connection point 36 for the separate conductor track connection 41 toward the AM/FM antenna connection pad 47, but with an irregular meander structure.

Figure 6:
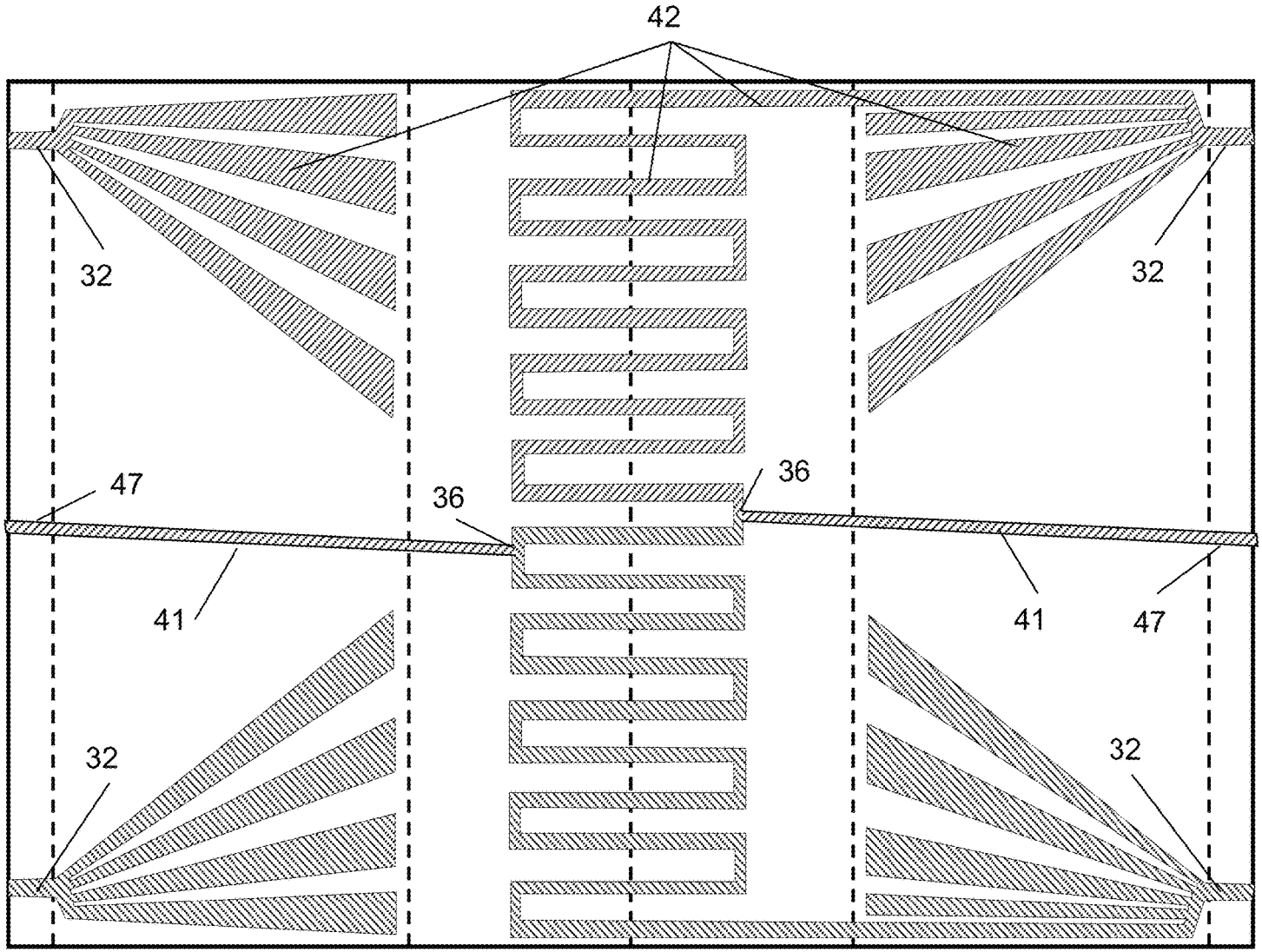

FIG. 6 shows a cutaway view variant in accordance with the invention as shown in FIG. 4 with two combined LTE antennas 42 and with two approximately central decouplings at top load connection points 36 at different points of the meandering conductor structure 37 at both sides. In a design of the film tube 8 by a kinking at the bending lines 9, the two AM/FM antenna connection pads 47 come together locally and are jointly contacted via the contact element 45 at the associated antenna connection point 4 on the insertion into the slit-shaped collection apparatus 30.

Figure 7:
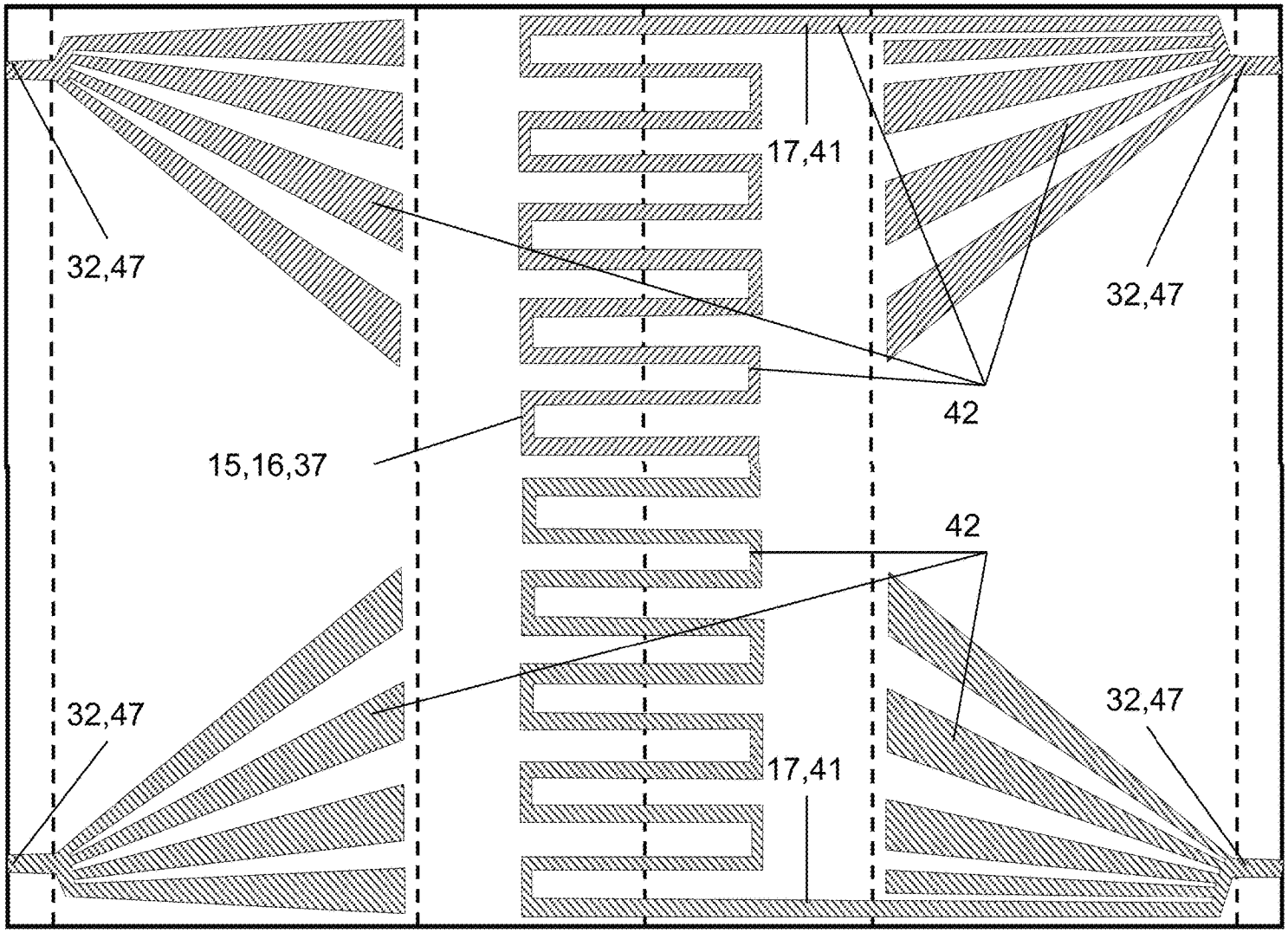

FIG. 7 shows a cutaway view variant in accordance with the invention as in FIG. 4, but without the central top load connection point 36 of the separate conductor track connection 41, but with the common conductor track connection 17, 41 to design a common connection pad 32, 47 as an LTE antenna connection pad 32 and an AM/FM antenna connection pad 47.

As further advantageous embodiments of the invention, a film tube 43 having a tube jacket open in the tube cross-section is designed in FIG. 8A. Said film tube 43 is designed with a plastic film 3 having shortened broad side margins 6*a*, 6*b*. This shape can be advantageous for reasons of material efficiency. The open tube jacket 13 is inscribed in the inner cross-section of the antenna protective cover 11 in FIG. 8*b* in such a manner that, when fastened, only one of the two longitudinal side margins 7*a* at the fastening line 44 impacts only one of the cross-section sides at contact points 27 at the height h1. Starting from there, the end 50 of the plastic film 3 is reached after a gable roof-shaped design of the cross-section of the open tubular structure for the areal roof capacity 15. Due to the shortening of the plastic film 3, one of the surfaces 19 oriented in a V shape and thus one of the triangular structures 20 is omitted at one side. To maintain the shape of a cone for the broadband monopole antenna 18 to be formed in the form of a pyramid standing on its apex, provision is therefore made in accordance with the invention to extend the rectangular plastic film 3—as shown in FIG. 10—at both sides by a first further conductive triangular structure 40 and, attached thereto, by a second further triangular structure 40*a*. The extension takes place in such a manner that the triangular structure 40*a* is attached via a common connection side 49 in such a manner that, after the design of the open film tube 8 by an approximately right-angled bending of the first further conductive triangular structure 40 along the broad side margin 6*a* and by an approximately right-angled bending of the second further triangular structure 40*a* along the common connection side 49 of the two mutually attached further triangular structures 40, 40*a*, the remaining triangular structure 20 and the second further triangular structure 40*a* are oriented in a V shape with respect to one another and the lower triangle apexes 21 of all the triangular structures 20, 40,40*a* are connected to the LTE antenna connection pad 32.

FIG. 11A:

Shows, similar to in FIGS. 3A-3C, in a perspective representation, the advantageous manner in which a large number of combined antennas 42 for frequencies below and above 1 GHz, each having a separate roof capacity 15 and a separate LTE antenna connection pad 32, can be arranged in series along the longitudinal side of the film tube 8. In addition, in an analogous way, more or less conical broadband monopole antennas 55 for frequencies above 6 GHz can be designed on the film tube and are arranged in the free spaces beside the combined antennas 42. These broadband antennas 55 are also each equipped with an antenna connection pad for contacting a connector on the base plate 5 designed as a coated circuit board 22.

Figure 11A:
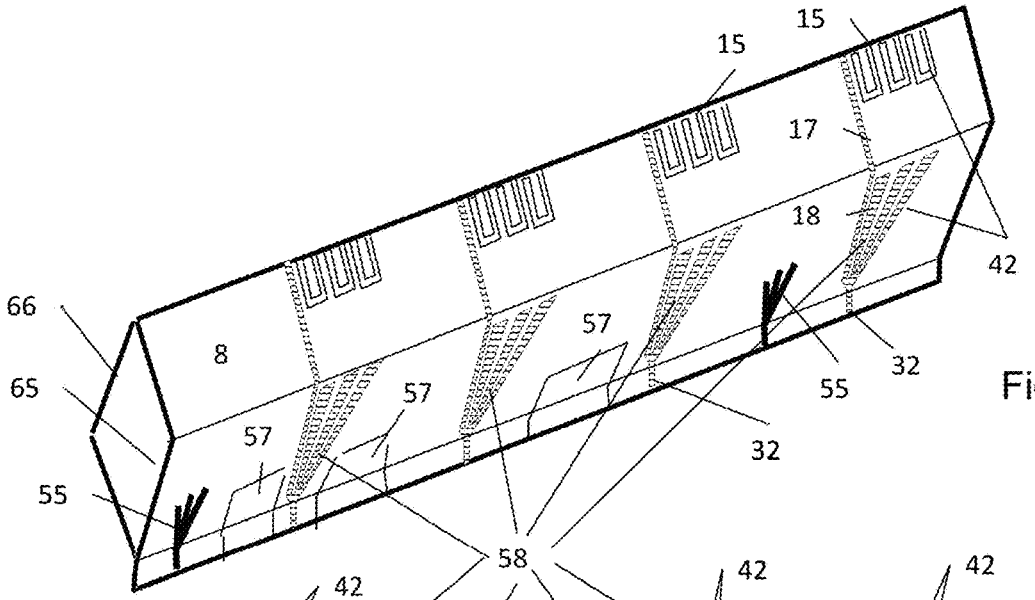
Figure 11B:
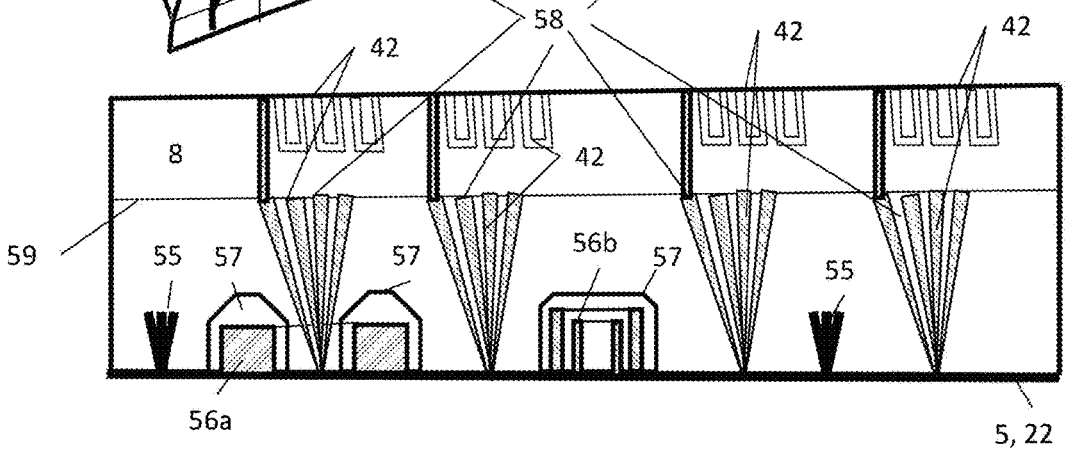

FIG. 11B:

In FIG. 11B, the film tube 8 equipped with antenna structures is shown from the side. The manner in which it is connected to the coated circuit board 22 can be seen from this. Further circuit components, such as a satellite ring antenna 56*a* and a satellite ring antenna 56*b* composed of concentric rings, can be attached to the coated circuit board 22 in a particularly advantageous manner. Corresponding cutouts 57 of the film tube 8 enable the spatial combination of the film tube with the coated circuit board 22. With the help of the electrical circuits designed as printed conductor tracks on the circuit board 22, antennas can, for example, be connected to one another to design directivity, etc. Antenna technologies such as multiple-input-multiple-output (MIMO) and the use of highly complex multi-antenna systems can be considered for modern communication systems.

FIGS. 12-14 show, by way of example, structures of combined LTE antennas 42 that can be applied to a film tube 8 in an advantageous manner, i.e. with little effort. What is shown in each case is the side view of a cutout of the film tube 8 with the structure of a combined LTE antenna 42 having an LTE connection pad 32 at the base point for forming the antenna connection point 4 on the electrically conductive base surface 5 as a coated circuit board 22.

In combined LTE antennas 42 of this kind, the matching value VSWR (voltage standing wave ratio)<3 is, for example, required in the entire frequency range for the matching of antenna systems to the standardized impedance of Z0=50 Ohm prescribed for vehicles. In the case of an antenna in accordance with the invention in its complete version at the antenna connection point 4, this value can generally already be achieved at an antenna height h of 6 cm. The properties of the monopole antenna 14 below 1 GHz are substantially determined by its antenna height h and by the size of the areal roof capacity 15 whose horizontal extent 16 of approximately 6 cm is substantially larger, that is approximately at least three times larger, than the vertical extent 61. A substantially larger vertical extent 61 indeed increases the capacitance value of the roof capacity 15, but reduces the effective height of the monopole antenna 14, which, in contrast to the capacitance value, is included as a square in the formation of the frequency bandwidth of this antenna.

The formation of a broadband monopole antenna for frequencies above 1 GHz 18 in FIG. 12 is substantially provided by the areal triangular structure 20 provided that the inductive effect of the conductor strips 17 having a narrow strip conductor width 64 is sufficiently large to separate radio signals with frequencies above 1 GHz from the roof capacity 15. Provision is made in accordance with the invention to provide the conductor strips 17 with meandering shapes 62 in order to increase this separating effect. Naturally, the functional division of the combined LTE antennas 42 into the monopole antenna 14 below 1 GHz and the broadband monopole antenna above 1 Ghz 18 should not be viewed strictly. Instead, the transition between the effects is smooth and the division is to be understood as a description for the main effects in the two frequency ranges. The mode of operation of the broadband monopole antenna above 1 Ghz 18 located above the conductive base surface 2 is substantially provided by the design of the areal triangular structure 20. In the interest of particularly broadband behavior, an areal triangular structure 4 standing on its apex and having a triangle opening angle 53 is provided in accordance with the invention whose apex is connected to the LTE antenna connection pad 32. The antenna connection point 4 for the combined LTE antenna 42 is formed by said LTE antenna connection pad 32 together with the ground connection point on the conductive base surface 5. The height of the base line of the areal triangular structure 18 above the conductive base surface 5 substantially forms the effective height of the broadband monopole antenna above 1 Ghz 18 by which the frequency behavior is substantially determined. For reasons of the vertical radiation pattern for the communication with terrestrial transmission points and reception points, the height of the broadband monopole antenna above 1 Ghz 18 at the upper LTE frequency limit should not be larger than about ⅓ of the free space wavelength. Values between 30 and 90 degrees have proven to be favorable as triangle opening angles 12. The triangular structure 18 with a broadband effect that is thereby produced, for example, makes it possible to maintain the value of VSWR=2.5 m in the frequency range above 1 Ghz for the likewise frequently made demand for the impedance matching at the base point.

To further improve the frequency bandwidth of the broadband monopole antenna above 1 GHz 18, a three-dimensional structure is formed therefor in an advantageous embodiment of the invention that is formed from the two-dimensional structure in the above-described manner in that an approximately congruent triangular structure 20 is applied at the oppositely disposed side of the surfaces 19 of the film tube 8 oriented in a V shape at the lower end so that an approximately conical structure is effective instead of the areal triangular structure 18.

For a better radiation decoupling with adjacent antennas or antenna structures, provision is made in accordance with the invention to design the areal triangular structure 20 by means of strip-shaped fins 39 converging in a fan-like manner at the lower triangle apex, as shown in FIG. 13. By attaching an identical structure to the oppositely disposed side of the surfaces 19 of the film tube 8 oriented in a V shape, an advantageously broadband more or less conical broadband monopole antenna above 1 GHz 18 is reproduced.

Figure 15:
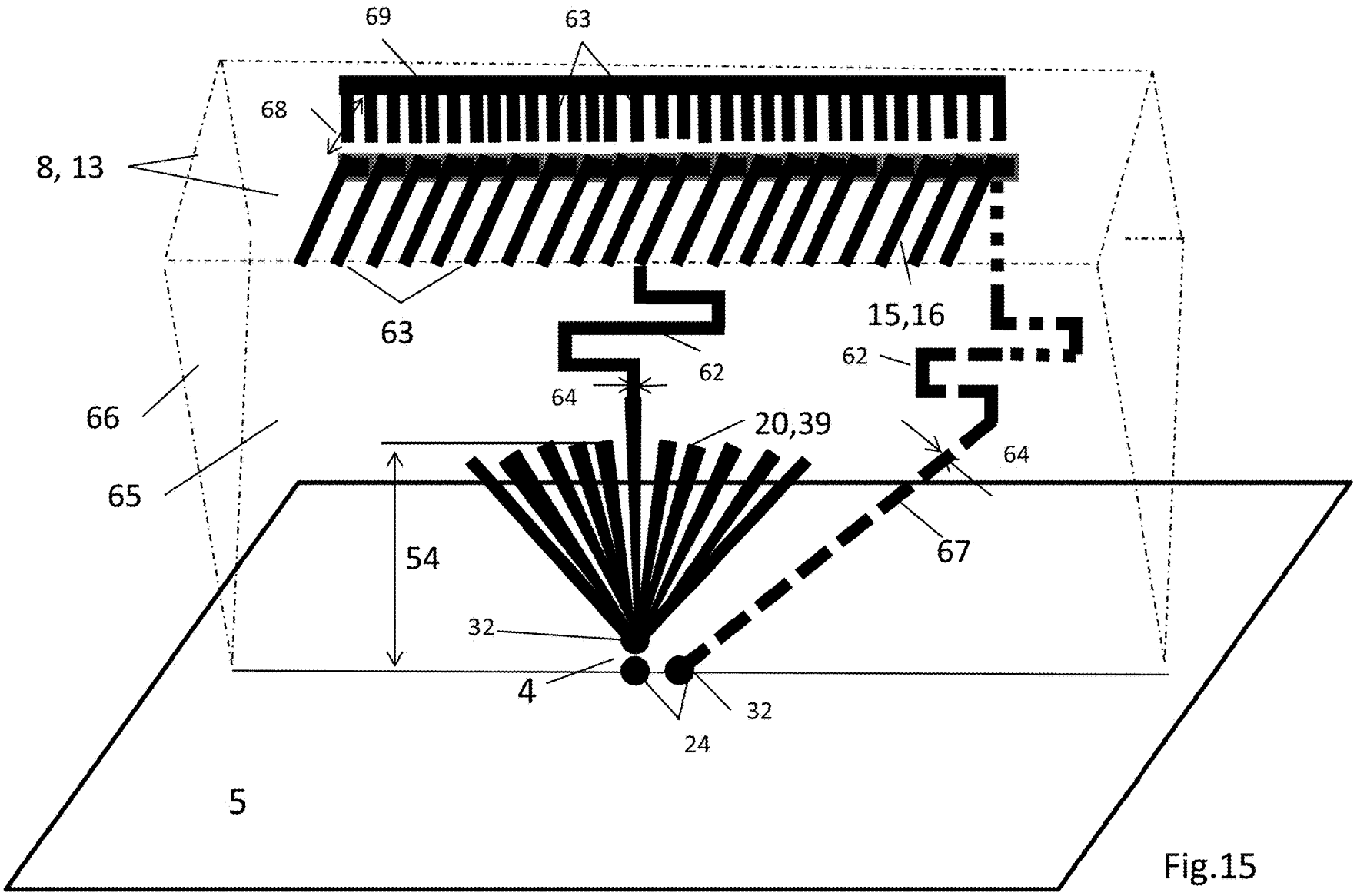

To improve the avoidance of interfering electromagnetic coupling between adjacent antenna structures and the areal rectangular structure of the monopole antenna 14 below 1 GHz forming the roof capacity 15, said rectangular structure is in accordance with the invention substantially designed by strip-shaped end fins 63, as shown in FIGS. 14 and 15, that extend vertically, electrically conductively and separate from one another, but are contiguous at their upper end via a remaining strip 16.

However, in the half-perspective side view of a cutout of the film tube 8 (chain-dotted) in FIG. 15, the structures of the LTE antenna 42 shown in FIG. 14 are applied to only one of the two sides of the tube jacket 13—the front tube jacket 65. A further rectangular structure 69, guided in parallel with the roof capacity 15 at a minimum spacing 68 substantially at a longitudinal side with respect to the roof capacity 15 and capacitively coupled thereto, is present at the side of the tube jacket 13 opposite thereto—that is on the rear tube jacket 66—in order to support the frequency range below 1 GHz. The connection of this rectangular structure 69 via a further conductor strip 67 (chain-dotted) to the ground connection 24 on the conductive base plate 5 provides the monopole antenna below 1 GHz with an extension of the frequency bandwidth at the lower frequency band end.

The further rectangular structure 69 is arranged at a minimum spacing 68 substantially in parallel with the first rectangular structure 16 and the further conductor strip 67 is designed with high impedance for frequencies above 1 GHz by the selection of a sufficiently small strip conductor width 64 and by meandering shapes 62. The roof capacity 15 and the further rectangular structure 69 can be selected in different sizes/magnitudes. The extension of the frequency range at the lower end of the LTE frequency band can be optimized by the selection of a suitable minimum spacing 68 in conjunction with the horizontal extent of the further rectangular structure 69. In accordance with the invention, the capacitive coupling of the longitudinally extended conductor structure 16 of the roof capacity 15 to the further rectangular structure 69 connected to ground 5 is particularly useful in particular for satisfying the matching requirement with VSWR<3 at the lowest frequencies of the LTE frequency band.

FURTHER ADVANTAGEOUS EMBODIMENTS ARE

A combination antenna in which the inner cross-section of the dielectric antenna protective cover 11 is substantially similar to the cross-section of a bell that tapers toward the tip and the cross-sectional shape of the folding bodies 8 of the inner surface 28 of the antenna protective cover 11 is inscribed in such a manner that, at the height h1 with a suitable selection of the opening angle 53 of the tube jacket surfaces 19 impacting one another in a V shape at the fastening line 44, bending lines 9 and suitable bending angles 35 are designed on both cross-section sides at contact points 27 with the inner antenna protective cover 11 and a further bending line with a bending angle 35 is present at the inner tip at the height h of the antenna protective cover 11 in such a manner that both a sufficient width and the full utilization of the available height h below the antenna protective cover 11 are provided in a gable roof-shaped design of the cross-section of the folding bodies 8 for the areal roof capacity 15.

A combination antenna in which, however, to further increase the effect of the roof capacity 15, a respective further bending line 9 with contact at the inner antenna protective cover 11 and a corresponding bending angle 35 are selected at a height h2 disposed above the height h1 above the base plate 5 on the cross-section sides, disposed opposite one another with respect to the cross-section center line 48, in such a manner that a mansard roof-shaped design of the structure for the areal roof capacity 15 is achieved.

A combination antenna in which, however, the inner cross-section of the dielectric antenna protective cover 11 is substantially similar to that of a semicircle and a respective further bending line with contact at the inner antenna protective cover 11 is selected at a large number of heights h2, h3, h4, . . . disposed above the height h1 above the base plate in such a manner that the tube jacket 13 above the height h1 is sequentially adapted to the cross-sectional semicircle and the cross-sectional width 46 of the areal structure of the roof capacity 15 is designed to optimize the effect.

A combination antenna in which a folding body 43 having a tube jacket 13 open in cross-section is inscribed in the inner cross-section of the antenna protective cover 11 in such a manner that, when only one of the two longitudinal side margins 7*a* is fastened to the fastening line 44, a bending line 9 and there a suitable bending angle 35 are designed at the height h1 on only one of the cross-section sides at contact points 27 with the inner antenna protective cover 11 and a further bending line 9 with a bending angle 35 is present at the inner tip at the height h of the antenna protective cover 11 in such a manner that, starting from there, the end 50 of the plastic film is reached after a gable roof-shaped design of the cross-section of the open tubular structure for the areal roof capacity 15.

A combination antenna in which, as compensation for the omission of one of the two triangular structures 20 oriented in a V shape with respect to one another for approximating the conical character of an LTE upper band antenna 31 at at least one of the longitudinal ends of the folding body 8, the planar plastic film 3 serving as the starting point is extended along the broad side margin 6*a* by a first further conductive triangular structure 40 and a second further triangular structure 40*a* is attached to the latter via a common connection side 49 in such a manner that, after the design of the open folding body 8 by a right-angled bending of the first further conductive triangular structure 40 along the broad side margin 6*a* and by a right-angled bending of the second further triangular structure 40*a* along the common connection side 49 of the two mutually attached further triangular structures 40, 40*a*, the remaining triangular structure 20 and the second further triangular structure 40*a* are oriented in a V shape with respect to one another and the lower triangle apexes 21 of all the triangular structures 20, 40,40*a* are connected to the LTE antenna connection pad 32.

A combination antenna in which, to approximate a conical character of an LTE upper band antenna 31 having an LTE antenna connection pad 32 at one of the longitudinal ends of the folding body 8, a conductive triangular structure 40 connected to the LTE antenna connection pad 32 is provided so that, after a bending of the conductive triangular structure 40 along a broad side margin 6*a*, two mutually oppositely disposed conductive triangular structures 20 are supplemented by the further conductive triangular structure 40 in the sense of a cone reproduction.

A combination antenna in which, however, the structures for designing the LTE antenna 42 are applied to one of the two sides of the tube jacket 13 and a substantially rectangular further structure 69, guided in parallel with the roof capacity 15 at a minimum spacing 68 substantially at a longitudinal side with respect to the roof capacity 15 and capacitively coupled to the latter, is present at the side of the tube jacket 13 opposite thereto in order to support the frequency range below 1 GHz and is connected to a further conductor strip 67 for designing a ground connection 24, said further conductor strip 67 being of high impedance for frequencies above 1 GHz and being provided with a connection pad 23 at its lower end.

REFERENCE NUMERAL LIST combination antenna 1
antenna structures 2
plastic film 3
antenna connection point 4
base plate 5
broad side margins 6*a*, 6*b*
longitudinal side margins 7*a*, 7*b*
folding body, film tube 8
bending lines 9
longitudinal direction 10
antenna protective cover 11
center line 12
tube jacket 13
monopole antenna below 1 GHz 14
roof capacity 15
longitudinally extended conductor structure 16
printed conductor track 17
broadband monopole antenna above 1 Ghz 18
surfaces 19 oriented in a V shape
triangular structure 20
triangle apexes 21
coated circuit board 22
connection pad 23
ground connection 24
hollow space 25
direction of travel 26
contact points 27
inner surface 28
edge tabs 29
slit-shaped collection apparatus 30
conical broadband monopole antenna 31
LTE antenna connection pad 32
AM/FM monopole antenna 33
contact point 34
bending angle 35
top load connection points 36
meandering conductor structure 37
oscillation amplitude 38
strip-shaped fins 39
first further conductive triangular structure 40
second further conductive triangular structure 40*a*
separate conductor track connection 41
combined LTE antenna 42
open film tube 43
fastening line 44
contact element 45
cross-sectional width 46
AM/FM antenna connection pad 47
cross-sectional center line 48
common connection side 49
film end 50
LTE upper band antenna 51
LTE lower band antenna 52
opening angle 53
triangle height 54
conical broadband monopole antenna above 6 GHz 55
satellite ring antenna 56*a*
satellite ring antennas 56*b*
cutout 57
antenna array 58
film kink line 59
longitudinal extent of top load 60
vertical extent of top load 61
meandering shape 62
end fins 63
strip conductor width 64
front tube jacket 65
rear tube jacket 66
further conductor strip 67
top load coupling spacing 68
further rectangular structure 69
strip 70
total extent h
heights h1, h2, h3,h4 . . . .

The invention claimed is:

1. A combination antenna (1) for mobile radio or for mobile radio and broadcasting services comprising at least one plastic film (3) arranged above a base plate (5) and coated with conductive antenna structures (2), comprising the following features:

a folding body (8) is formed from the plastic film (3);

the folding body (8) is designed by an at least simple bending along at least one bending line (9) in a longitudinal direction (10);

at least one longitudinal side margin (7*a*, 7*b*) of the plastic film (3) is bent over along a fastening line (44) and is mechanically connected to the base plate (5) in parallel with a center line (12) of the base plate (5) extending at a longitudinal side, whereby the folding body (8) is segmented by the bending line (9) and the longitudinal side margin (7*a*, 7*b*); and at least one monopole antenna (14) for radio services with frequencies below 1 GHz and at least one broadband monopole antenna (18) for radio services with frequencies above 1 Ghz are present that are each formed from conductive antenna structures (2) and that are each provided with an antenna connection point (4) on the base plate (5), wherein the cross-section of the folding body (8) is in particular formed as a polygon standing on its apex.

2. A combination antenna (1) in accordance with claim 1, characterized in that, to design the at least one monopole antenna (14) for radio services below 1 GHz, at least one longitudinally extended areal conductor structure (16) designed as a roof capacity (15) is present in an upper region of the folding body (8) located above the conductive base plate (5), said conductor structure (16) being connected at at least one point via a conductor track (17) printed onto the folding body (8) to an antenna connection point (4) formed on the fastening line (44); and/or in that, to design the at least one broadband monopole antenna (18) for frequencies above 1 Ghz, the folding body (8) has two surfaces (19) in a lower region which are oriented in a V shape with respect to one another and on each of which a conductive triangular structure (20) standing on a triangle apex (21) is applied, with both triangle apexes (21) that converge at the bottom comprising an antenna connection point (4).

3. A combination antenna (1) in accordance with claim 1, characterized in that the electrically conductive base plate (5) is designed as a coated circuit board (22) having a respective cutout of the conductive layer for designing a respective antenna connection point (4), comprising a connection pad (23) on the plastic film (3) and a ground connection (24) on the circuit board (22).

4. A combination antenna (1) in accordance with claim 1, characterized in that the folding body (8) is inserted into a shell-like dielectric antenna protective cover (11) having an inner hollow space (25) and having an opening margin and the antenna protective cover (11) is mechanically connected to the conductive base plate (5) at its opening margin.

5. A combination antenna (1) in accordance with claim 4, characterized in that, to mechanically stabilize and fix the folding body (8), the wall of the inner hollow space (25) has at least one molded-on contact edge that enables a line contact along a contact line (27) between the bending line (9) of the plastic film (3) and the inner surface (28) of the antenna protective cover.

6. A combination antenna (1) in accordance with claim 1, characterized in that at least one edge tab (29) is formed at at least one longitudinal side margin (7*a*, 7*b*) of the coated plastic film (3) and the electrically conductive base plate (5) is designed as a circuit board (22) along whose center line (12) at least one slit (30) is formed into which the edge tab (29) is inserted and is thereby mechanically held.

7. A combination antenna (1) in accordance with claim 6, characterized in that, to electrically couple at least one antenna structure (2) to an antenna connection point (4), a connection pad (23) is provided on the at least one edge tab (29) and a contact element (45) for contacting the connection pad (23) is present on the base plate (5).

8. A combination antenna (1) in accordance with claim 1, characterized in that at least one combined LTE antenna (42) is formed, comprising the broadband monopole antenna (18) for the LTE upper band having the character of a conical monopole antenna (31) and an antenna for the LTE lower band, comprising the vertical monopole antenna (14) having a separate longitudinally extended conductor structure (16) designed as a roof capacity (15) in the upper region of the folding body (13), located above the conductive base plate (5), having a printed conductor track (17) to an LTE antenna connection pad (32) common to both frequency bands.

9. A combination antenna (1) in accordance with claim 1, characterized in that a plurality of combined LTE antennas (42) are provided of which at least two comprise the same roof capacity (15) that is connected via a respective printed conductor track (17) to a separate connection pad (23).

10. A combination antenna (1) in accordance with claim 1, characterized in that antenna structures (2) are present on the plastic film (3) for at least one combined LTE antenna (42) having a longitudinally extended conductor structure (16) designed as a roof capacity (15) and for an AM/FM monopole antenna (33) for AM/FM radio reception comprising the same longitudinally extended areal conductor structure (16) as a roof capacity (15), but having a separate conductor track connection (41) to a separate AM/FM antenna connection pad (47), and a respective separate antenna connection point (4) is formed on the fastening line (44) for each combined LTE antenna (42).

11. A combination antenna (1) in accordance with claim 1, characterized in that a respective combined LTE antenna (42) having a printed conductor track (17) between the end of the conductor structure (16), longitudinally extended over the folding body (8), of the roof capacity (15) and the respective combined LTE antenna connection pad (32) is present at both ends of the folding body (8) and the top load connection point (36) of the separate conductor track (41) to the conductor structure (16) of the roof capacity (15) toward the AM/FM antenna connection pad (47) is provided approximately at the longitudinal-side center of the folding body (8).

12. A combination antenna (1) in accordance with claim 1, characterized in that an LTE combination antenna (42) having a triangular structure (20) and having a conductor track (17) to a conductive structure of a roof capacity (15) disposed thereabove is printed at at least one of the longitudinal-side ends of the folding body (8) and an AM/USW monopole antenna (33) is present that is connected to the same structure for the roof capacity (15) via a separate conductor track connection (41), with mutually spaced apart top load connection points (36) in particular being provided for the decoupling of the two antennas.

13. A combination antenna (1) in accordance with claim 1, characterized in that, instead of the closed areal structure of the roof capacity (15), the electromagnetic decoupling of the two mutually spaced apart top load connection points (36) is increased by the inductive effect of a meandering conductor structure (37) having an oscillation amplitude (38) over the cross-sectional width (46) of the areal structure of the roof capacity (15).

14. A combination antenna (1) in accordance with claim 1, characterized in that, to improve the electromagnetic decoupling between the broadband monopole antenna (18) for the LTE upper band and the monopole for the LTE lower band, the broadband monopole antenna (18) has an areal triangular structure (20) that is designed by strip-shaped fins arranged in a fan-like manner in the triangle plane and converging at the lower triangle apex (21).

15. A combination antenna (1) in accordance with claim 1, characterized in that a plurality of combined LTE antennas (42) for frequencies below and above 1 GHz, each having a separate roof capacity (15) and a separate LTE antenna connection pad (32), are arranged in series along the longitudinal side of the folding body (8).

* * * * *